US011237504B2

(12) United States Patent
Ito et al.

(10) Patent No.: US 11,237,504 B2
(45) Date of Patent: Feb. 1, 2022

(54) IMAGE FORMING APPARATUS, IMAGE FORMING METHOD, AND COMPUTER-READABLE RECORDING MEDIUM WITH PROGRAM RECORDED THEREIN

(71) Applicant: CANON KABUSHIKI KAISHA, Tokyo (JP)

(72) Inventors: Shingo Ito, Tokyo (JP); Kohei Okayasu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/003,079

(22) Filed: Aug. 26, 2020

(65) Prior Publication Data

US 2021/0063924 A1 Mar. 4, 2021

(30) Foreign Application Priority Data

Aug. 29, 2019 (JP) ..... JP2019-157043

(51) Int. Cl.
*G03G 15/20* (2006.01)

(52) U.S. Cl.
CPC ..... *G03G 15/2039* (2013.01)

(58) Field of Classification Search
CPC ..... G03G 15/2039–205
See application file for complete search history.

(56) References Cited

U.S. PATENT DOCUMENTS

| | | | | |
|---|---|---|---|---|
| 2014/0270835 | A1* | 9/2014 | Umezawa | G03G 15/2042 399/69 |
| 2016/0004195 | A1* | 1/2016 | Ozawa | G03G 15/2039 399/69 |
| 2018/0004135 | A1* | 1/2018 | Sako | G03G 15/2039 |
| 2018/0024476 | A1* | 1/2018 | Sato | G03G 15/2039 399/69 |
| 2018/0067427 | A1* | 3/2018 | Obayashi | G03G 15/2039 |
| 2019/0101854 | A1* | 4/2019 | Taguchi | G03G 15/2039 |
| 2019/0121268 | A1* | 4/2019 | Endo | G03G 15/2039 |
| 2020/0333732 | A1* | 10/2020 | Uchiyama | G03G 15/2042 |
| 2020/0333733 | A1* | 10/2020 | Tsuchihashi | G03G 15/2039 |

FOREIGN PATENT DOCUMENTS

| | | | |
|---|---|---|---|
| JP | 2016004231 | A | 1/2016 |
| JP | 2018040874 | A | 3/2018 |
| JP | 2019066824 | A | 4/2019 |
| JP | 2019138959 | A | 8/2019 |

* cited by examiner

*Primary Examiner* — Carla J Therrien
(74) *Attorney, Agent, or Firm* — Venable LLP

(57) ABSTRACT

An image forming apparatus including: an obtaining portion that divides image data into a plurality of regions in a sub scanning direction, and obtains, for each of the plurality of regions in the sub scanning direction, a first value relating to pixels having density at at least a prescribed value in a first width and a second value relating to pixels having density at at least the prescribed value in a second width, which is greater than the first width; a determining portion that determines, for each of the plurality of regions, a target temperature for maintaining a temperature of a heating member on the basis of the first and second values; and a control portion that controls power supplied to the heating member so that the temperature of the heating member is maintained at the target temperature.

19 Claims, 14 Drawing Sheets

*FIG.6B*

X=3

| N=2 | N=3 | N=4 |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |

. . .

*FIG.8*

| FIRST REGION | | M3 (RANK) | | | | | |
|---|---|---|---|---|---|---|---|
| | | 0 | 1 | 2 | 3 | 4 | 5 |
| M28 (RANK) | 0 | 14 | | | | | |
| | 1 | | 14 | 14 | 14 | 14 | 14 |
| | 2 | | 11 | 12 | 13 | 14 | 14 |
| | 3 | | 8 | 9 | 10 | 12 | 14 |
| | 4 | | 6 | 6 | 7 | 7 | 8 |
| | 5 | | 0 | 0 | 0 | 0 | 0 |

| SECOND REGION | | M3 (RANK) | | | | | |
|---|---|---|---|---|---|---|---|
| | | 0 | 1 | 2 | 3 | 4 | 5 |
| M28 (RANK) | 0 | 14 | | | | | |
| | 1 | | 12 | 13 | 13 | 13 | 13 |
| | 2 | | 10 | 11 | 11 | 12 | 13 |
| | 3 | | 8 | 8 | 9 | 10 | 11 |
| | 4 | | 5 | 5 | 6 | 6 | 7 |
| | 5 | | 0 | 0 | 0 | 0 | 0 |

| THIRD REGION | | M3 (RANK) | | | | | |
|---|---|---|---|---|---|---|---|
| | | 0 | 1 | 2 | 3 | 4 | 5 |
| M28 (RANK) | 0 | 14 | | | | | |
| | 1 | | 12 | 12 | 12 | 12 | 12 |
| | 2 | | 8 | 9 | 10 | 11 | 12 |
| | 3 | | 5 | 6 | 7 | 8 | 9 |
| | 4 | | 3 | 3 | 3 | 4 | 4 |
| | 5 | | 0 | 0 | 0 | 0 | 0 |

| FOURTH REGION | | M3 (RANK) | | | | | |
|---|---|---|---|---|---|---|---|
| | | 0 | 1 | 2 | 3 | 4 | 5 |
| M28 (RANK) | 0 | 14 | | | | | |
| | 1 | | 11 | 11 | 11 | 11 | 11 |
| | 2 | | 7 | 8 | 9 | 10 | 11 |
| | 3 | | 5 | 5 | 6 | 7 | 8 |
| | 4 | | 3 | 3 | 3 | 4 | 4 |
| | 5 | | 0 | 0 | 0 | 0 | 0 |

| FIFTH REGION | | M3 (RANK) | | | | | |
|---|---|---|---|---|---|---|---|
| | | 0 | 1 | 2 | 3 | 4 | 5 |
| M28 (RANK) | 0 | 14 | | | | | |
| | 1 | | 10 | 10 | 10 | 10 | 10 |
| | 2 | | 5 | 6 | 7 | 8 | 9 |
| | 3 | | 3 | 3 | 4 | 5 | 6 |
| | 4 | | 2 | 2 | 2 | 3 | 3 |
| | 5 | | 0 | 0 | 0 | 0 | 0 |

FIG.12

| FIRST REGION | | |
|---|---|---|
| M28 (RANK) | 0 | 14 |
| | 1 | 14 |
| | 2 | 11 |
| | 3 | 8 |
| | 4 | 6 |
| | 5 | 0 |

| SECOND REGION | | |
|---|---|---|
| M28 (RANK) | 0 | 14 |
| | 1 | 12 |
| | 2 | 10 |
| | 3 | 8 |
| | 4 | 5 |
| | 5 | 0 |

| THIRD REGION | | |
|---|---|---|
| M28 (RANK) | 0 | 14 |
| | 1 | 12 |
| | 2 | 8 |
| | 3 | 5 |
| | 4 | 3 |
| | 5 | 0 |

| FOURTH REGION | | |
|---|---|---|
| M28 (RANK) | 0 | 14 |
| | 1 | 11 |
| | 2 | 7 |
| | 3 | 5 |
| | 4 | 3 |
| | 5 | 0 |

| FIFTH REGION | | |
|---|---|---|
| M28 (RANK) | 0 | 14 |
| | 1 | 10 |
| | 2 | 5 |
| | 3 | 3 |
| | 4 | 2 |
| | 5 | 0 |

IMAGE G

IMAGE FORMING APPARATUS, IMAGE FORMING METHOD, AND COMPUTER-READABLE RECORDING MEDIUM WITH PROGRAM RECORDED THEREIN

BACKGROUND OF THE INVENTION

Field of the Invention

The present invention relates to an electrophotographic or electrostatic recording type image forming apparatus such as a printer, e.g., a laser printer and an LED printer, and a digital copier.

Description of the Related Art

A technique is available that controls the temperature of a fixing unit in accordance with the amount of toner (toner bearing amount) on an image, obtained from image data. Japanese Patent Application Publication No. 2016-4231 discloses a method for dividing image data into areas each including, for example, 32 dots×32 dots, and determining a target temperature for fixing on the basis of the toner amount of an area having the greatest toner amount among all the areas and the print rate of the entire image.

During fixing, when the maximum amount of toner is large, the target temperature is raised, and when the maximum amount of toner is small, the target temperature is lowered. In this way, the toner image is prevented from being fixed at an unnecessarily high target temperature with the intension to reduce the power consumption of the image forming apparatus.

SUMMARY OF THE INVENTION

In the method of controlling the target temperature according to the maximum toner amount as in the prior art, when, for example, an image extends over two regions in a recording material conveying direction, even if the maximum toner amount is the same between the regions, it may be difficult with this method to deal with a situation where the target temperature has to be changed. More specifically, when an image extends over two regions in a sub scanning direction, which is a recording material conveying direction, the target temperature may not reach an appropriate temperature. The present invention is directed to solve to the problem, and it is an object of the present invention to determine an appropriate target temperature depending on an image.

In order to achieve the object described above, an image forming apparatus including:

an image forming portion that forms on a recording material a toner image according to image data;

a fixing portion that holds the recording material at a nip portion formed between a fixing member having a heating member therein and a pressing member and fixes the toner image onto the recording material;

an obtaining portion that divides the image data into a plurality of regions in a sub scanning direction, and obtains, for each of the plurality of regions in the sub scanning direction, a first value relating to pixels having density at at least a prescribed value in a first width and a second value relating to pixels having density at at least the prescribed value in a second width, which is greater than the first width;

a determining portion that determines, for each of the plurality of regions, a target temperature for maintaining a temperature of the heating member on the basis of the first and second values; and a control portion that controls power supplied to the heating member so that the temperature of the heating member is maintained at the target temperature.

In order to achieve the object described above, an image forming method for an image forming apparatus including an image forming portion that forms on a recording material a toner image according to image data and a fixing portion that holds the recording material at a nip portion formed between a fixing member having a heating member therein and a pressing member and fixes the toner image onto the recording material, the method being executed by a computer and comprising steps of:

dividing the image data into a plurality of regions in a sub scanning direction, and obtaining, for each of the plurality of regions in the sub scanning direction, a first value relating to pixels having density at at least a prescribed value in a first width and a second value relating to pixels having density at at least the prescribed value in a second width, which is greater than the first width;

determining, for each of the plurality of regions, a target temperature for maintaining a temperature of the heating member on the basis of the first and second values; and controlling power supplied to the heating member so that the temperature of the heating member is maintained at the target temperature.

In order to achieve the object described above, a computer-readable recording medium with a program recorded therein for causing a computer to execute steps in an image forming method for an image forming apparatus including an image forming portion that forms on a recording material a toner image according to image data and a fixing portion that holds the recording material at a nip portion formed between a fixing member having a heating member therein and a pressing member and fixes the toner image onto the recording material, the program causing the computer to execute the steps of:

dividing the image data into a plurality of regions in a sub scanning direction, and obtaining, for each of the plurality of regions in the sub scanning direction, a first value relating to pixels having density at at least a prescribed value in a first width and a second value relating to pixels having density at at least the prescribed value in a second width, which is greater than the first width;

determining, for each of the plurality of regions, a target temperature for maintaining a temperature of the heating member on the basis of the first and second values; and controlling power supplied to the heating member so that the temperature of the heating member is maintained at the target temperature.

According to the present invention, an appropriate target temperature can be determined according to an image.

Further features of the present invention will become apparent from the following description of exemplary embodiments with reference to the attached drawings.

BRIEF DESCRIPTION OF THE DRAWINGS

FIG. 6B is a diagram for illustrating an example of how the moving average value for the total number of printed pixels is calculated using three blocks;

FIG. 8 shows target temperature tables for various regions according to the first embodiment;

FIG. 12 show target temperature tables for various regions according to a second comparative example.

DESCRIPTION OF THE EMBODIMENTS

Embodiments of the present invention will now be described with reference to the drawings. Dimensions, materials, shapes of the components and the relative positions thereof described in the embodiments may be appropriately changed depending on the configuration of an apparatus to which the present invention is applied, and on various conditions, and are not intended to limit the scope of the invention to the following embodiments.

First Embodiment

Image Forming Apparatus

Figure 1:
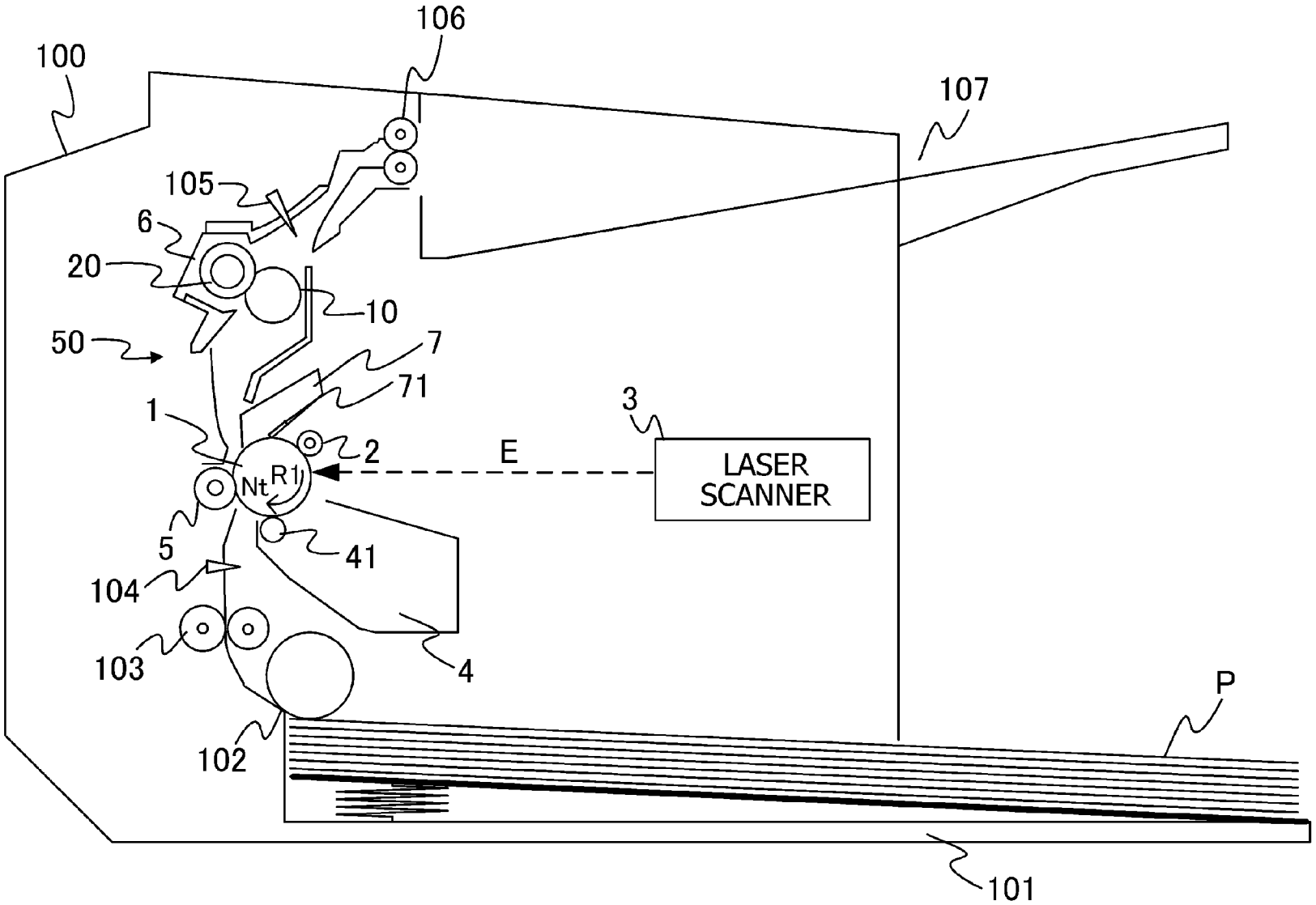
FIG. 1 is a view (cross-sectional view) of the structure of an image forming apparatus according to a first embodiment.

FIG. 1 shows an image forming apparatus according to the present invention, in other words, an image forming apparatus including a heating/fixing apparatus and a printer control apparatus according to the present invention. Note that FIG. 1 is a schematic longitudinal sectional view of the structure of an image forming apparatus according to a first embodiment. The structure of the laser printer (hereinafter referred to as the "image forming apparatus") will be described in detail with reference to FIG. 1. The image forming apparatus 100 is, for example, a printer such as a laser printer and an LED printer, or an electrophotographic or electrostatic recording type image forming apparatus such as a digital copier.

The image forming apparatus 100 shown in FIG. 1 includes an image forming unit (image forming portion) 50. The image forming unit 50 includes a drum-type electrophotographic photosensitive member (hereinafter referred to as a "photosensitive drum") 1 as an image bearing member, a charging roller 2, a laser scanner 3, a developing apparatus 4, a transfer roller 5, a heating/fixing apparatus 6, and a cleaning device 7. The image forming unit 50 forms a toner image corresponding to image data on a recording material P. The photosensitive drum 1 includes a cylinder-shaped drum substrate of an aluminum alloy or nickel and a photosensitive material such as organic photo-semiconductor (OPC) and amorphous silicon provided on the drum substrate on a cylinder. The photosensitive drum 1 is driven by driving means (not shown) to rotate in the direction of the arrow R1 at a prescribed processing speed (circumferential speed). The surface of the photosensitive drum 1 is uniformly charged to a prescribed polarity/potential by the charging roller (charging means) 2. The charged photosensitive drum 1 forms an electrostatic latent image by a laser beam E from the laser scanner (exposure means) 3. The laser scanner 3 subjects the photosensitive drum to exposure, the ON/OFF of which is controlled according to image information, in the longitudinal direction of the photosensitive drum 1, removes the charge of the exposed part, and forms an electrostatic latent image on the surface of the photosensitive drum 1. The electrostatic latent image is developed and visualized by the developing apparatus (developing means) 4. The developing method may be a jumping developing method, a two-component developing method, or a contact developing method, and image exposure and inverted developing may be combined. The electrostatic latent image described above is developed as a toner image (toner image) as the toner is deposited by the developing roller 41. According to the first embodiment, a jumping development method is used.

The toner image on the photosensitive drum 1 is transferred to the surface of the recording material (transfer material) P. The recording material P stored in a sheet feed tray 101 is fed on a one-sheet-basis by a sheet feed roller 102, and is fed to a transfer nip portion Nt between the photosensitive drum 1 and the transfer roller 5 for example through a conveying roller 103. At this time, the front end of the recording material P is sensed by a top sensor 104, and timing when the front end of the recording material P reaches the transfer nip portion Nt is detected on the basis of the position of the top sensor 104, the position of the transfer nip portion Nt, and the transfer speed of the recording material P. The toner image on the photosensitive drum 1 is transferred on the recording material P fed and conveyed in the prescribed timing as described above by applying a transfer bias on the transfer roller (transfer means) 5.

The recording material P with the toner image transferred thereon is conveyed to the heating/fixing apparatus (fixing means) 6. The recording material P is conveyed as being sandwiched at the nip portion between the film unit 10 and the pressure roller 20 of the heating/fixing apparatus 6 while being heated and pressurized, so that the toner image is fixed onto the surface of the recording material P. Thereafter, the recording material P is ejected onto a discharge tray 107 formed at the upper surface of the image forming apparatus 100 by the discharge roller 106. Meanwhile, the discharge sensor 105 detects the timing in which the front end and the rear end of the recording material P pass, and for example the presence/absence of a jam is monitored. Meanwhile, in the photosensitive drum 1 after the toner image is transferred thereon, the toner (untransferred toner) remaining on the surface without being transferred to the recording material P is removed by the cleaning blade 71 of the cleaning device (cleaning means) 7, and the untransferred toner is provided for the next image to be formed. The above operation is repeatedly carried out, so that images can be formed one after another. The image forming apparatus 100 according to the first embodiment may have a resolution of 600 dpi, a speed of 30 sheets/min (LTR longitudinal feed: a process speed of about 200 mm/s), and a lifetime of 100,000 sheets.

Printer Control Apparatus

Figure 2A:
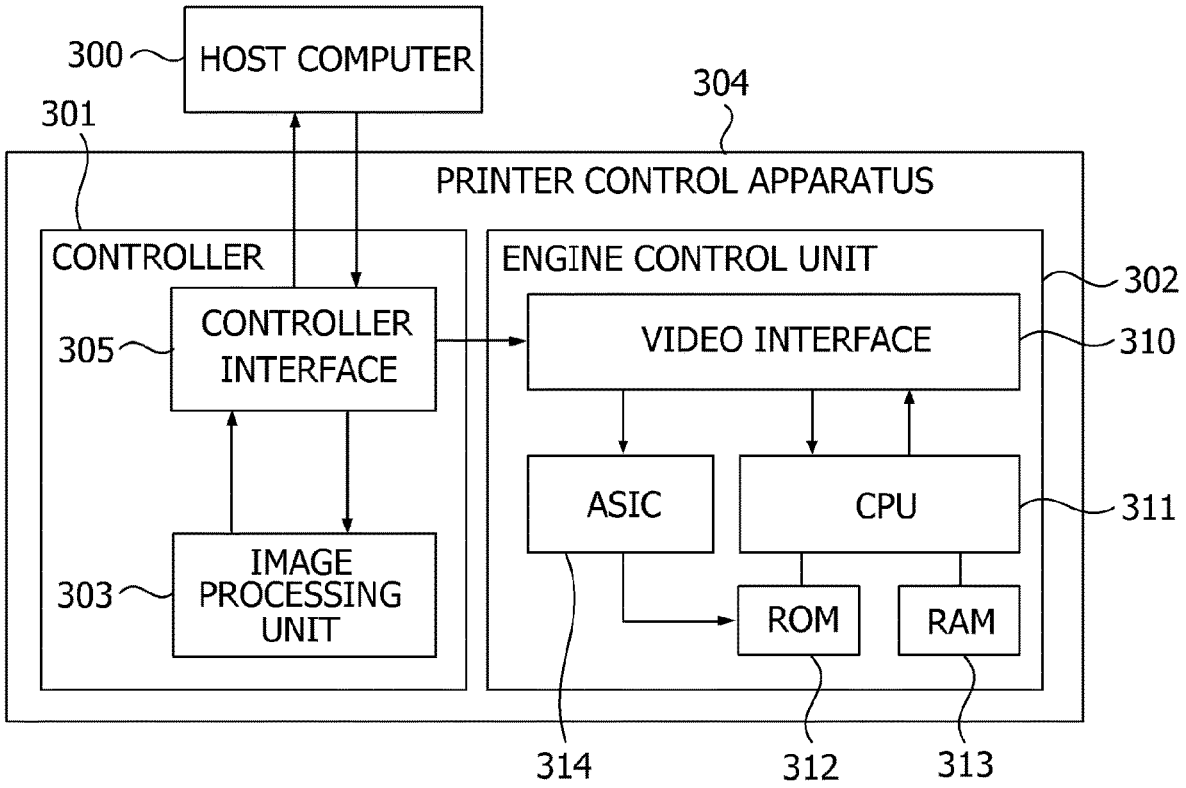
FIG. 2A is a diagram of a configuration of a printer system according to the first embodiment.

A printer control apparatus 304 according to the first embodiment will be described with reference to FIG. 2A. The printer control apparatus 304 is incorporated in the image forming apparatus 100 which communicates with a host computer 300. FIG. 2A is a diagram of the configuration of a printer system (image forming system) according to the first embodiment. The host computer 300 may be a server or personal computer on a network such as the Internet or a local area network (LAN), or a personal digital assistant such as a smartphone or a tablet terminal. The printer control apparatus 304 communicates with the host computer 300 using a controller interface 305. The printer control apparatus 304 is roughly divided into a controller 301 and an engine control unit 302. The controller 301 includes an image processing unit 303 and a controller interface 305. The image processing unit 303 performs bit mapping to a character code or half-toning processing to a grayscale image on the basis of information received from the host computer 300 through the controller interface 305. The controller 301 also transmits image information through the controller interface 305 to the video interface 310 of the engine control unit 302. The image information includes information about the target temperature (hereinafter referred to as the target temperature) for maintaining the heater 11 at a temperature calculated by the image processing unit 303. The calculation method will be described in detail.

The controller 301 transmits information about timing for turning on the laser scanner 3 to an application specific integrated circuit (ASIC) 314. Meanwhile, the controller 301 transmits a print mode and image size information to a central processing unit (CPU) 311. The controller 301 may transmit information about the timing for turning on the laser scanner 3 to the CPU 311. The CPU 311 is also referred to as a processor. The CPU 311 is not limited to a single processor, but instead it may have a multiprocessor configuration. The CPU 311 performs various kinds of control to the engine control unit 302 using a ROM 312 or a RAM 313. The controller 301 transmits a printing command, a cancellation instruction, or the like to the engine control unit 302 in response to an instruction given by the user on the host computer 300 and controls the operation such as starting or stopping of printing operation.

Figure 2B:
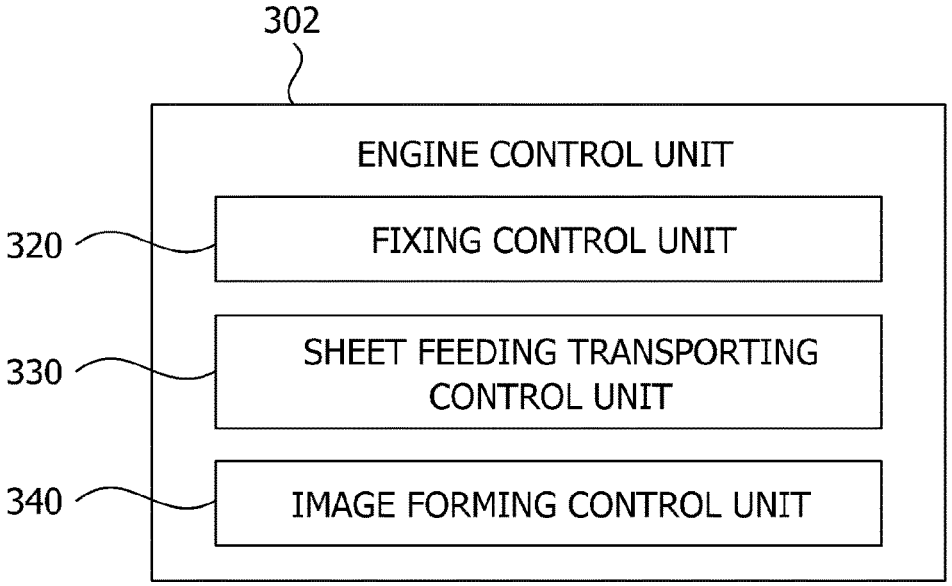
FIG. 2B is a diagram of an exemplary functional block of an engine control unit according to the first embodiment.

FIG. 2B is a diagram illustrating an example of a function block of the engine control unit 302 according to the first embodiment. As shown in FIG. 2B, the engine control unit 302 includes a fixing control unit 320, a sheet feed transporting control unit 330, and an image forming control unit 340. The CPU 311 stores information in the RAM 313, uses programs stored in the ROM 312 or RAM 313, and refers to information stored in the ROM 312 or RAM 313 as needed. As the CPU 311 performs these kinds of processing, the engine control unit 302 functions as various parts shown in FIG. 2B. The fixing control unit 320 controls the temperature of the heating/fixing apparatus 6. The sheet feeding transporting control unit 330 controls the operation interval of the sheet feed roller 102. The image forming control unit 340 performs process speed control, development control, charging control, and transfer control. Some of these kinds of processing performed by the image forming apparatus 100 may be performed by the host computer 300 or a server on a network. Some or all of these kinds of processing performed by the engine control unit 302 and the image processing unit 303 may be performed by the host computer 300 or a server on the network. The host computer 300 and the server on the network are examples of processing devices. Alternatively, some or all of these kinds of processing performed by the engine control unit 302 may be performed by the image processing unit 303, or some or all of these kinds of processing performed by the image processing unit 303 may be performed by the engine control unit 302.

Fixing Apparatus

Figure 3:
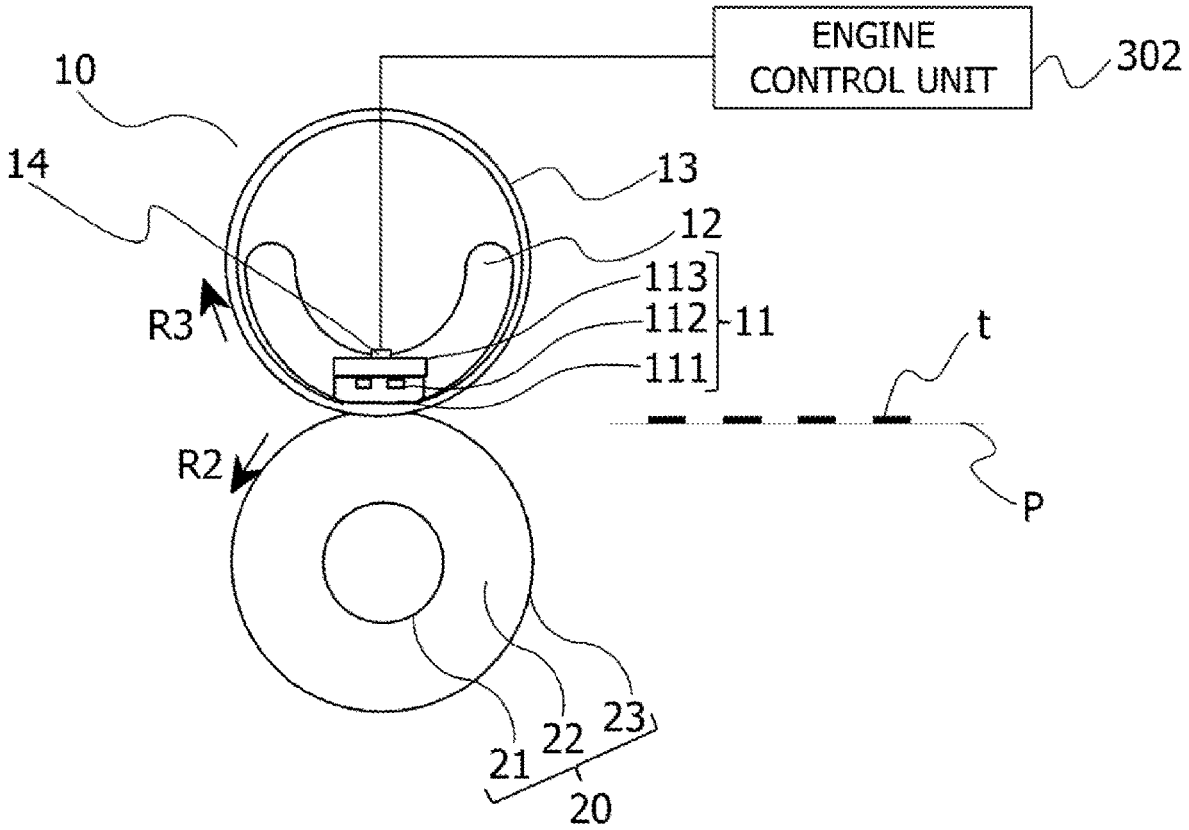
FIG. 3 is a view (cross-sectional view) of a heating/fixing apparatus according to the first embodiment.

With reference to FIG. 3, the film heating type heating/fixing apparatus 6 according to the embodiment will be described. The heating/fixing apparatus 6 includes a film unit 10 as a heating device and a pressure roller 20. The film unit 10 includes a fixing film (heat resistant film) 13 which is a rotating body for heating as a heat transfer member, a heater 11 that is a heating member, and a holder 12 that is a heater retaining member. A heater 11 is provided inside the fixing film 13. The heating/fixing apparatus 6 is provided with the pressure roller (pressing rotating member) 20 as a member opposed to the film unit 10. The heating/fixing apparatus 6 having the configuration holds and transfers the recording material P having a toner image t thereon at the fixing nip portion (the pressure contact nip portion or the nip portion) formed between the fixing film 13 and the pressure roller 20. In this way, the toner image t conveyed together with the fixing film 13 is fixed to the recording material P. The heating/fixing apparatus 6 is an example of the fixing unit (fixing portion). The fixing film 13 is an example of the fixing member. The pressure roller 20 is an example of the pressing member.

As shown in FIG. 3, a thermistor 14 as a temperature sensing member is provided at and in abutment against the surface of the heater 11 opposite to the sliding surface with the fixing film 13. The engine control unit 302 controls the current of the heater 11 on the basis of a temperature sensed by the thermistor 14 so that the temperature of the heater 11 is maintained at a desired temperature. For example, the temperature of the heater 11 is adjusted by controlling the current flowing through the heater 11 by the fixing control unit 320 in response to a signal from the thermistor 14.

Fixing Film

The fixing film 13 is a composite layer film including a coating or a tube-coating of a releasable layer for example of PFA, PTFE, or FEP provided directly or through a primer layer on the surface of a thin metal element tube such as a SUS tube. Instead of the metal element tube, a base layer formed by kneading a heat-resistant resin such as polyimide and a heat-conducting filler such as graphite into a tubular shape may be used. The fixing film 13 according to the first embodiment uses a film including base layer polyimide and a coating of PFA thereon. The total film thickness of the fixing film 13 is 80 μm and the outer peripheral length of the fixing film 13 is 56 mm. Since the fixing film 13 rotates while rubbing against the heater 11 and the holder 12, the frictional resistance between the heater 11 and the holder 12 and the fixing film 13 must be reduced. Therefore, a small amount of lubricant such as heat resistant grease is interposed between the surfaces of the heater 11 and the holder 12. This allows the fixing film 13 to rotate smoothly.

Pressure Roller

The pressure roller 20 shown in FIG. 3 includes a core bar 21 made for example of iron, an elastic layer 22, and a release layer 23. The elastic layer 22 is formed by foaming heat-resistant rubber such as insulating silicone rubber or fluorine rubber on the core bar 21, and primer-treated, adhesive RTV silicone rubber as an adhesive layer is applied on the elastic layer 22. The release layer 23 covered or coated with a tube having a conductive agent such as carbon dispersed for example in PFA, PTFE, or FEP is formed on the elastic layer 22 through an adhesive layer. According to the first embodiment, the outer diameter of the pressure roller 20 is 20 mm, and the hardness of the pressure roller 20 is 48° (Asker-C with 600 g load). The pressure roller 20 is pressed by pressing means (not shown) with 15 kg·f from both ends in the longitudinal direction so that a nip portion necessary for heating and fixing is formed. The pressure roller 20 is driven to rotate in the direction of the arrow R2 (counterclockwise) shown in FIG. 3 by rotation driving (not shown) from the longitudinal end through the core bar 21. Therefore, the fixing film 13 is rotated outside the holder 12 in the direction of the arrow R3 (clockwise) in FIG. 3.

Heater

As shown in FIG. 3, the heater 11 is provided in the fixing film 13. The heater 11 includes a substrate (insulating substrate) 113 made of alumina or aluminum nitride as ceramic and a resistive heat-generating layer (heating-generating element) 112 formed on the substrate 113. For the insulation and abrasion resistance of the resistive heat-generating layer 112, the resistive heat-generating layer 112 is covered with thin overcoat glass 111, and the overcoat glass 111 is in contact with the inner peripheral surface of the fixing film 13. The overcoat glass 111 has high voltage resistance and abrasion resistance and is configured to slide against the fixing film 13. The overcoat glass 111 according to the first embodiment has a heat conductivity of 1.0 W/m·K and a withstand voltage characteristic of at least 2.5 KV, and a film thickness of 70 μm. Alumina is used for the substrate 113 of the heater 11 according to the first embodiment. The substrate 113 has a width of 6.0 mm, a length of 260.0 mm, and a thickness of 1.00 mm, and a thermal expansion coefficient of $7.6\times10^{-6}$/° C. The resistive heat-generating layer 112 according to the first embodiment is made of a silver palladium alloy, and the resistive heat-generating layer 112 has a total resistance value of 20Ω, and the temperature dependence of resistivity is 700 ppm/° C. The heater 11 is an example of the heating member.

Holder

The holder 12 is an insulating stay holder which holds the heater 11 and prevents heat dissipation to the back of the nip portion, and is made for example of liquid crystal polymer, phenolic resin, PPS, or PEEK. The fixing film 13 is externally fitted to the holder 12 with a margin, and the fixing film 13 is rotatably provided. According to the first embodiment, the material of the holder 12 is a liquid crystal polymer, and the holder 12 has a heat resistance of 260° C., and a thermal expansion coefficient of $6.4\times10^{-5}$.

Engine Control Unit

The engine control unit 302 has a control program and controls the temperature of the heater 11 at a prescribed target temperature on the basis of a temperature sensed by the thermistor 14. More specifically, the engine control unit 302 controls power supplied to the heater 11 so that the temperature of the heater 11 is maintained at the target temperature. The engine control unit 302 is an example of the control unit (control portion). As the control means, PID control based on proportional, integral, and derivative terms is preferably applied. The control expression 1 is as follows.

$$f(t)=\alpha1\times e(t)+\alpha2\times\Sigma e(t)+\alpha3\times(e(t)-e(t-1)) \quad \text{(Expression 1)}$$

where t is control timing, f(t) is the ratio of heater energization time in a control cycle at control timing (t) (1 or more is fully lit), e(t) is the temperature difference between a target temperature and an actual temperature in the current control timing (t), e(t−1) is the temperature difference between the target temperature and the actual temperature in the last control timing (t−1), α1 to α3 are gain constants, α1 is a P (proportional) term gain, α2 is an I (integral) term gain, and α3 is a D (derivative) term gain In the order from the first term on the right-hand side of Expression 1, the terms correspond to proportional control, integral control, and derivative control. Here, α1 to α3 are proportional coefficients for weighting increase or decrease in the ratio of the energization time for the heater 11 within a control period. When α1 to α3 are set according to the characteristics of the heating/fixing apparatus 6, appropriate temperature control can be carried out. The engine control unit 302 determines the energizing time for the heater 11 within the control period according to the value of f(t) and drives a heater energizing time control circuit (not shown) to determine the output power by the heater 11. Control by setting the D term gain to 0 such that only the P term and the I term function is called PI control, and the control by the PI control may be performed if the D term is not necessary. According to the first embodiment, the control timing is updated at the intervals of 100 msec as a control period, and the P-term gain (α1) is 0.05° C.−1, the I term gain is 0.01° C.−1(α2), and the D term gain is 0.001° C.−1(α3). According to the first embodiment, when the value of f(t) is 1, the energizing time within the control period is maximized, and when the calculation result is greater than 1, energization for the maximum energizing time within the control period is performed.

Figure 4:
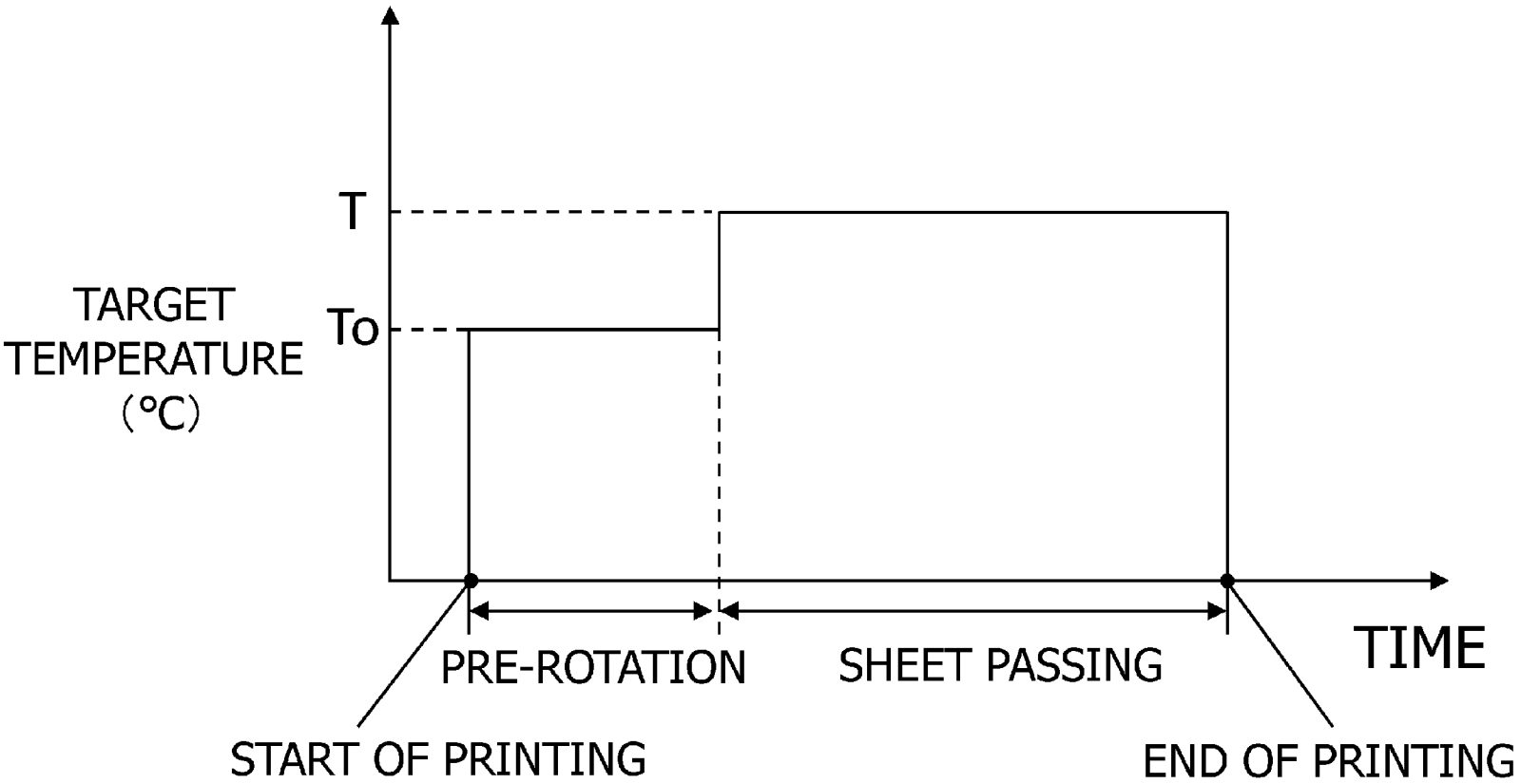
FIG. 4 is a graph for illustrating a target temperature control sequence according to the first embodiment.

In response to the printing operation step by the image forming apparatus 100, the temperature of the heater 11 is controlled by the target temperature control sequence shown in FIG. 4. As shown in FIG. 4, the power supply to the heater 11 is controlled so that the temperature of the heater 11 during a pre-rotation period (from the start of the printing operation until the tip end of the recording material P enters the fixing nip portion) is maintained at a target temperature To. The target temperature To is 180° C. As shown in FIG. 4, the power supply to the heater 11 is controlled so that the temperature of the heater 11 during a sheet passing period (between entry of the front end of the recording material P to the fixing nip portion and exit of the rear end of the recording material P from the fixing nip portion) is maintained at the target temperature T. The power supply to the heater 11 is controlled so that the temperature of the heater 11 during a sheet interval period (between exit of the rear end of the recording material P from the fixing nip portion and entry of the subsequent recording material P to the fixing nip portion) is maintained at the target temperature. The target temperature T during the sheet interval period is determined by the following calculation method in the range from 190° C. to 204° C. The target temperature during the sheet interval period is, for example, 190° C.

Step of Calculating Target Temperature from Image Information

The image processing unit 303 includes a processor such as a CPU and a memory such as a ROM and a RAM. The image processing unit 303 performs half-toning to a gray-scale image and also calculates a target temperature from image information. Hereinafter, the processing performed by the image processing unit 303 when a toner image corresponding to image data is formed on the surface of one recording material P will be described by way of illustration.

Figure 5:
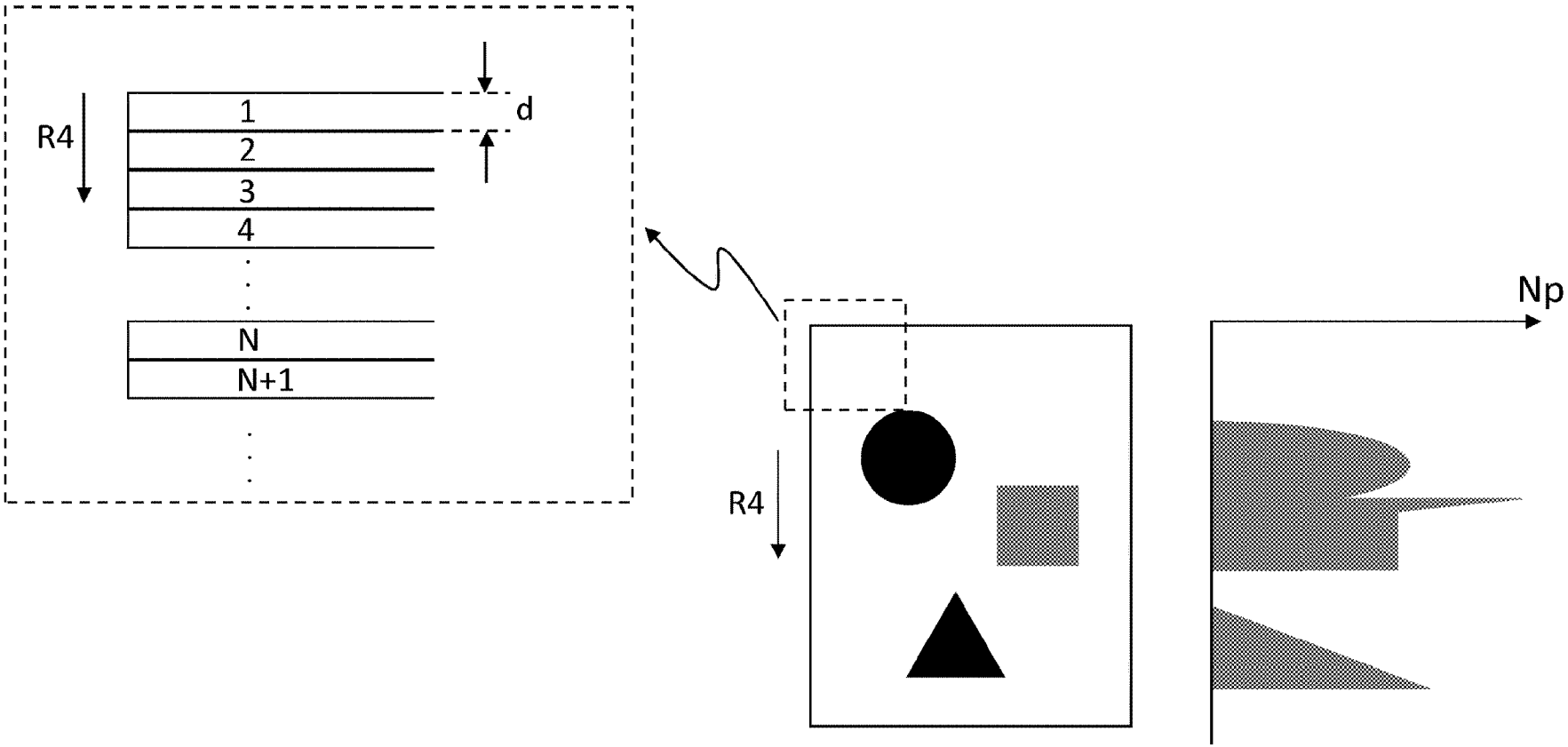
FIG. 5 is a diagram for illustrating the concept of pixel information obtained from an image pattern.

According to the first embodiment, image data is separated (divided) in the sub scanning direction (the conveying direction of the recording material P), and the entire region of the image data in the main scanning direction (the direction perpendicular to the conveying direction of the recording material P)×a length d (=2 mm) of the image data in the sub scanning direction is defined as one block. Therefore, the number of pixels in the main scanning direction in one block (a first number) is greater than the number of pixels in the sub scanning direction in one block (a second number). More specifically, the resolution of one block in the main scanning direction (a first resolution) is higher than the resolution of one block in the sub scanning direction (a second resolution). The image processing unit 303 divides image data into a plurality of blocks in the sub scanning direction, and it counts the total number of pixels having density at at least a prescribed value included in each block. For example, the image processing unit 303 counts the total number of pixels having a gray density of at least 4% in each block. The total number of printed pixels (pixels having density at at least a prescribed value) included in each block is Np (pixels). FIG. 5 shows a concept of information obtained from image data. In FIG. 5, the image data is shown in the center, the left part shows the image data surrounded by the dotted line, and the right part shows a distribution of the number of printed pixels (Np) in the sub scanning direction (the R4 direction in FIG. 5). According to the first embodiment, all the pixels having a gray density of at least 4% are counted as printed pixels.

For example, in an electrophotographic laser printer, image data is read in the direction perpendicular to the conveying direction of the recording material P (the main scanning direction) and converted into data such as pulse width data, and the data is transmitted sequentially to the laser scanner 3. Therefore, the processing of sending the data to the laser scanner 3 using the image data read in the main scanning direction is used in common in the image processing of determining a target temperature. In this way, the memory usage area and the time required for processing can be smaller than for example the case of dividing the entire image data into regular square regions of 32 pixels for image analysis.

The image processing unit 303 calculates a moving average value for the total number of printed pixels (pixel information) in each block. The total number of printed pixels in each block is the total number of pixels having density at at least a prescribed value counted for the block. The moving average method is the processing of determining an average value for the total number of printed pixels per block among X blocks while moving in the sub scanning direction. Stated differently, according to the moving average method, the width of a prescribed number of blocks continuous in the sub scanning direction is set as a moving average width and the average value (moving average value) of the total number of printed pixels per block is calculated while moving the moving average width in the sub scanning direction on a block basis. Therefore, the average value (moving average value) is calculated by dividing the total number of printed pixels in the plurality of blocks included in the moving average width by the number of blocks included in the moving average width every time the position of the moving average width in the sub scanning direction is changed.

Figure 6A:
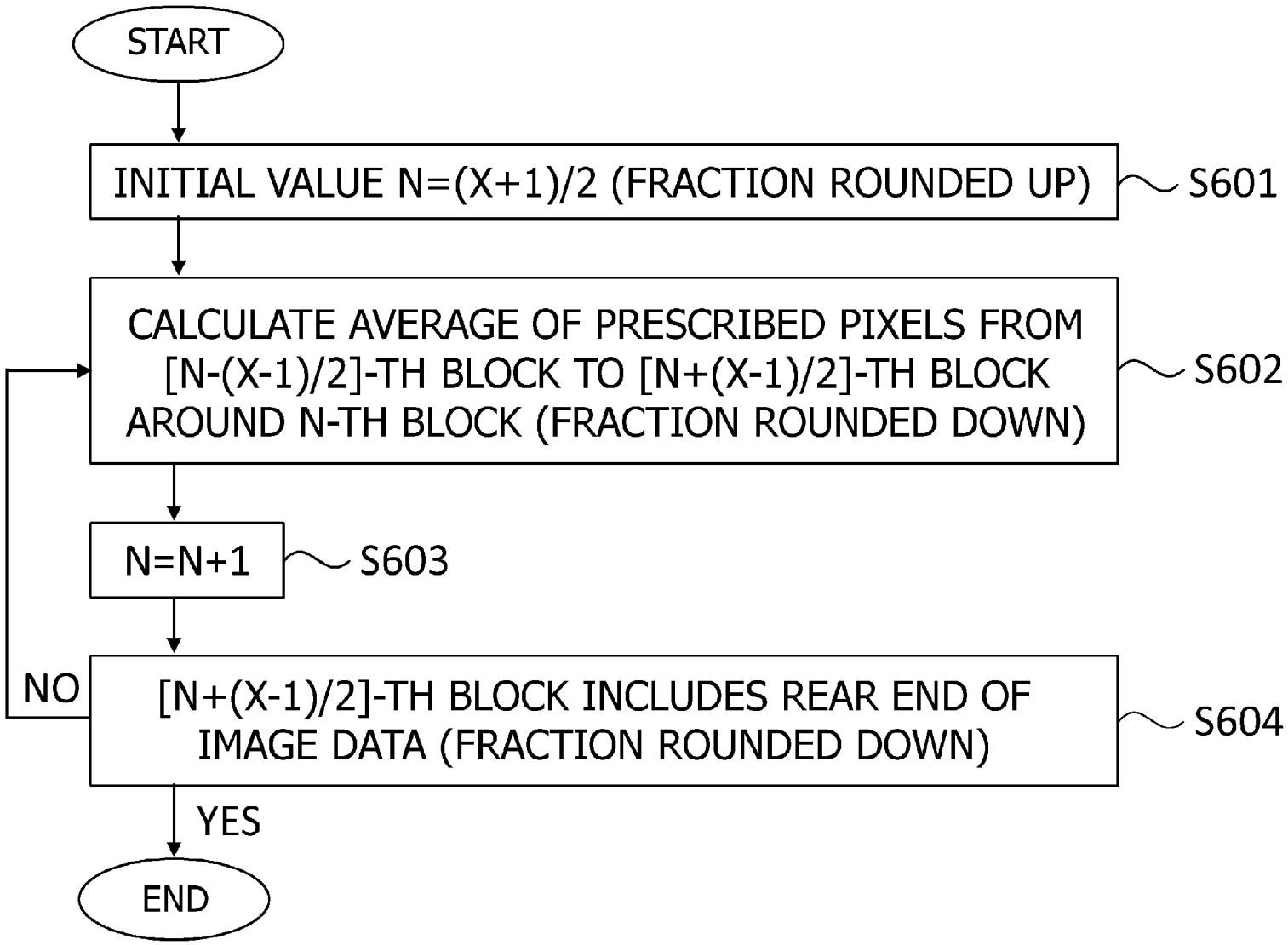
FIG. 6A is a flow chart for illustrating the processing of calculating a moving average value according to the first embodiment.

FIG. 6A shows the flow of the processing of calculating a moving average value in each block. FIG. 6B shows an example of how a moving average value for the total number of printed pixels is calculated with reference to the processing using three blocks (X=3). In S601, the image processing unit 303 calculates an initial value N (initial value N=(X+1)/2). For example, if X=3, the initial value N is 2. In S602, the image processing unit 303 calculates an average total number of printed pixels on a block basis among the [N−(X−1)/2]-th block to the [N+(X−1)/2]-the block with the N-th block in the center. In S603, the image processing unit 303 updates the initial value N(N=N+1). In S604, the image processing unit 303 determines whether the [N+(X−1)/2]-th block includes the rear end of the image data in the sub scanning direction. When the [N+(X−1)/2]-th block includes the rear end of the image data in the sub scanning direction (YES in S604), the flow of the calculation processing for the moving average value ends. Meanwhile, when the [N+(X−1)/2]-th block does not include the rear end of the image data in the sub scanning direction (NO in S604), the processing returns to S602. When X=3, for example, the moving average value for the total number of printed pixels in the second block is the average of the total numbers of printed pixels from the first block to the third block. For example, when X=3, the moving average value for the total number of printed pixels in the third block is the average of total numbers of printed pixels from the second block to the fourth block.

Figure 7A:
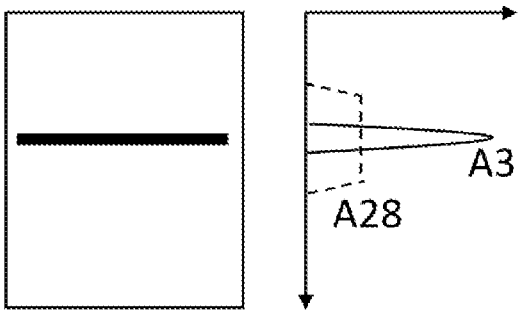
FIGS. 7A and 7B are views for illustrating an exemplary moving average value for the total number of print pixels with respect to a sub scanning direction.
Figure 7B:
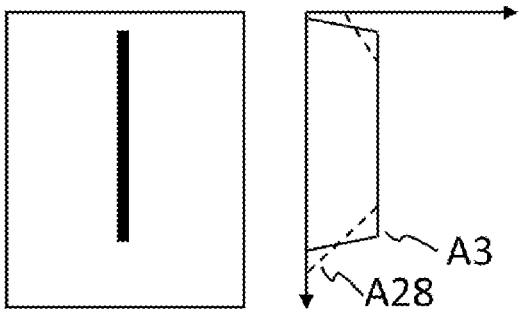

In the description of the first embodiment, the moving average value for the total number of printed pixels using two moving average widths X, X=3 and X=28 by way of illustration. When the moving average values for the total number of printed pixels are calculated using the two moving average widths X(X=3 and X=28), the moving average distributions are denoted as moving average distributions A3 and A28. Exemplary moving average values for the total number of printed pixels in the sub scanning direction are shown in FIGS. 7A and 7B. In the image of a horizontal line shown in FIG. 7A, the moving average distribution A3 has a peaky (steep) shape, and the moving average distribution A28 has a mild shape. Meanwhile, in the image of a vertical line shown in FIG. 7B, the moving average distributions A3 and A28 have approximately the same shape and the same maximum moving average value.

An example of the processing by the image processing unit 303 will be described. The image processing unit 303 moves the moving average width X (X=3) in the sub scanning direction on a block basis and obtains a moving average value for the total numbers of printed pixels in the plurality of blocks for each of the plurality of blocks. The image processing unit 303 moves the moving average width X (X=28) in the sub scanning direction on a block basis and obtains a moving average value for the total numbers of printed pixels in the plurality of blocks for each of the plurality of blocks. The moving average width X (X=3) and the moving average width X (X=28) are different widths in the sub scanning direction. The moving average width X (X=3) in the sub scanning direction is smaller than the moving average width X (X=28) in the sub scanning direction. Stated differently, the moving average width X (X=28) in the sub scanning direction is larger than the moving average width X (X=3) in the sub scanning direction. The moving average width X (X=3) is an example of the first width. The moving average width X (X=28) is an example of the second width. The image processing unit 303 moves a plurality of different moving average widths in the sub scanning direction on a block basis in the sub scanning direction and obtains a moving average value for the total numbers of printed pixels in the plurality of blocks for each of the plurality of blocks. The image processing unit 303 is an example of the obtaining unit (obtaining portion).

The image processing unit 303 separates (divides) image data into a plurality of regions each having a plurality of blocks in the sub scanning direction. If the length of the outer circumference of the fixing film 13 is set to a prescribed distance (Dfmm), the region from the front end of the image data to a first position which is the prescribed distance (Dfmm) apart in the sub scanning direction is set as a first region. The region from the rear end in the first region (a position Dfmm apart from the front end of the image data) to a second position which is the prescribed distance (Dfmm) apart in the sub scanning direction is defined as a second region. In the sub scanning direction, the region from the rear end of the second region (a position 2×Dfmm apart from the front end of the image data) to a third position which is the prescribed distance (Dfmm) apart is defined as a third region. In the sub scanning direction, the region from the rear end of the third region (a position 3×Dfmm apart from the front end of the image data) to a fourth position which the prescribed distance (Dfmm) apart is defined as the fourth region. In the sub scanning direction, the region from the rear end in the fourth region (a position 4×Dfmm away from the front end of the image data) to the rear end of the image data is defined as a fifth region.

The positional relation among the first to fifth regions will be described.

(1) The first region is an upstream region located upstream of the second, third, fourth, and fifth regions in the sub scanning direction.

(2) In the positional relation between the first and second regions, the second region is a downstream region located downstream in the first region in the sub scanning direction. In the positional relation among the second, third, fourth and fifth regions, the second region is an upstream region located upstream of the third, fourth, and fifth regions in the sub scanning direction.

(3) In the positional relation among the first, second, and third regions, the third region is a downstream region located downstream of the first and second regions in the sub scanning direction. In the positional relation among the third, fourth, and fifth regions, the third region is an upstream region located upstream of the fourth and fifth regions in the sub scanning direction.

(4) In the positional relation among the first, second, third, and fourth regions, the fourth region is a downstream region located downstream of the first, second, and third regions in the sub scanning direction. In the positional relation between the fourth and fifth regions, the fourth region is an upstream region located upstream of the fifth region in the sub scanning direction.

(5) The fifth region is a downstream region located downstream of the first, second, third, fourth, and fifth regions in the sub scanning direction.

Since the length of the recording material P of the A4 size is approximately five times the length of the outer periphery of the fixing film 13, the number of regions for the image data is set to five. For example, when the length of the outer periphery of the fixing film 13 is shorter than the prescribed distance (Dfmm) or when a sheet of a Legal-sized recording material P is used, the number of regions of image data is more than 5. The image processing unit 303 calculates a maximum value (maximum moving average value) for the moving average values of the total numbers of printed pixels in a plurality of blocks for each of the first to fifth regions. In this way, the image processing unit 303 determines the maximum moving average value for the total numbers of printed pixels in the plurality of blocks included in each of the plurality of regions. Hereinafter, a maximum moving average value for the moving average distribution A3 is denoted as a maximum moving average value (M3), and a maximum moving average value for the moving average distribution A28 is denoted as a maximum moving average value (M28). The image processing unit 303 calculates the maximum moving average values (M3 and M28) in each of the first to fifth regions.

An example of the processing by the image processing unit 303 is illustrated. In the sub scanning direction, the image processing unit 303 obtains the maximum moving average value (M3) for the total number of printed pixels in the moving average width X(X=3) and the maximum moving average value (M28) for the total number of printed pixels in the moving average width X(X=28) for each of the plurality of regions. The maximum moving average value (M3) for the total number of printed pixels in the moving average width X(X=3) is an example of "a first value related to pixels having density at at least a prescribed value in a first width." The maximum moving average value (M28) for the total number of printed pixels in the moving average width X(X=28) is an example of "a second value related to pixels having density at at least a prescribed value in a second width." The image processing unit 303 calculates a first average value by dividing the total number of printed pixels in a plurality of blocks included in the moving average width X(X=3) by the number of blocks included in the moving average width X(X=3) every time the position of the moving average width X(X=3) in the sub scanning direction is changed. The moving average value calculated using the moving average width X(X=3) is an example of the first average value. The image processing unit 303 calculates a plurality of first average values for each region. The image processing unit 303 obtains a maximum moving average value for the total number of printed pixels in the moving average width X(X=3) on the basis of the first average value. Specifically, the image processing unit 303 obtains the maximum moving average value (M3) for the total number of printed pixels in the moving average width X(X=3) by selecting the maximum value among the plurality of the first average values in each region. The image processing unit 303 calculates a second average value by dividing the total number of printed pixels in a plurality of blocks included in the moving average width X(X=28) by the number of blocks included in the moving average width X(X=28) every time the position of the moving average width X(X=28) in the sub scanning direction is changed. The image processing unit 303 calculates a plurality of second average values for each region. The moving average value calculated using the moving average width X(X=28) is an example of the second average value. The image processing unit 303 obtains a maximum moving average value for the total number of printed pixels in the moving average width X(X=28) on the basis of the second average value. Specifically, the image processing unit 303 obtains the maximum moving average value (M28) for the total number of printed pixels in the moving average width X(X=28) by selecting the maximum value among the plurality of second average values of each region. Hereinafter, the processing by the image processing unit 303 for determining a target temperature T on the basis of the maximum moving average values (M3 and M28) will be described. The image processing unit 303 is an example of the determining unit (determining portion). The image processing unit 303 classifies the maximum moving average values (M3 and M28) in each region into six ranks (0 to 5) using the threshold table shown in Table 1 below.

TABLE 1

| Rank | Maximum moving average in each region |
|---|---|
| 0 | 0 |
| 1 | 0 < M < 3000 |
| 2 | 3000 ≤ M < 6000 |
| 3 | 6000 ≤ M < 12000 |
| 4 | 12000 ≤ M < 24000 |
| 5 | 24000 ≤ M |

The image processing unit 303 refers to the target temperature table for each of the first to fifth regions, and uses values corresponding to the rank of the maximum moving average values (M3 and M28) in each region to determine an individual target temperature in each of the first to fifth regions. As described above, the image processing unit 303 determines the individual target temperatures in the plurality of regions on the basis of the maximum moving average value determined for each of the plurality of regions. The target temperature table may be stored in the memory of the image processing unit 303. FIG. 8 shows a target temperature table for each of the first to fifth regions. Each value in the target temperature tables in FIG. 8 shows a subtraction value from a reference temperature (204° C.). The reference temperature is for example the temperature which allows a toner image to be fixed to the recording material P when the image data includes an image pattern which is the most difficult to fix.

For example, the case in which the maximum moving average value (M3) in the first region is classified as the rank 4 and the maximum moving average value (M28) in the first region is classified as the rank 3 will be described. In this case, the image processing unit 303 determines an individual target temperature (192° C.) in the first region by referring to the target temperature table for the first region and subtracting the value (12° C.) corresponding to the maximum moving average value (M3, M28) in the first region from the reference temperature (204° C.). When the value of the rank for the maximum moving average value (M28) is smaller, the size of the toner image formed on the recording material P is smaller, and thus the individual target temperature can be lowered. As for a solid white image with no printed pixels, the maximum moving average value (M3, M28) is classified as the rank 0, so that the subtraction value is 14° C. As for an image with a high print rate such as a solid black image, the maximum moving average value (M3, M28) is classified as the rank 5, so the subtraction value is 0° C., and the individual target temperature is 204° C.

As shown in Table 1, when the maximum moving average value (M3) and the maximum moving average value (M28) in the first region are each 2000, the maximum moving average value (M3) and the maximum moving average value (M28) in the first region are each classified as the rank 1. As shown in Table 1, when the maximum moving average value (M3) and the maximum moving average value (M28) in the fourth region are each 2000, the maximum moving average value (M3) and the maximum moving average value (M28) in the fourth region are each classified as the rank 1. As shown in FIG. 8, when the maximum moving average values (M3, M28) in the first region are classified as the rank 1, the individual target temperature in the first region is 190° C. (204° C. to 14° C.). As shown in FIG. 8, when the maximum moving average values in the fourth region (M3, M28) are classified as the rank 1, the individual target temperature in the fourth region is 193° C. (204° C. to 11° C.). The increase rate in the individual target temperature in the first region with respect to the maximum moving average value (M3) in the first region is 9.50% (=190/2000). The increase rate in the individual target temperature in the fourth region with respect to the maximum moving average value (M3) in the fourth region is 9.65% (=193/2000).

Therefore, the increase rate in the individual target temperature in the fourth region with respect to the maximum moving average value (M3) in the fourth region is greater than the increase rate in the individual target temperature in the first region with respect to the maximum moving average value (M3) in the first region. In this way, the increase rate in the individual target temperature in the downstream region with respect to the maximum moving average value (M3) in the downstream region is larger than the increase rate in the individual target temperature in the upstream region with respect to the maximum moving average value (M3) in the upstream region. The increase rate in the individual target temperature in the downstream region with respect to the maximum moving average value (M3) in the downstream region is an example of "the increase rate in the target temperature in the downstream region with respect to the first value in the downstream region." The increase rate in the individual target temperature in the upstream region with respect to the maximum moving average value (M3) in the upstream region is an example of "the increase rate in the target temperature in the upstream region with respect to the first value in the upstream region."

The increase rate in the individual target temperature in the first region with respect to the maximum moving average value (M28) in the first region is 9.50% (=190/2000). The increase rate in the individual target temperature in the fourth region with respect to the maximum moving average value (M28) in the fourth region is 9.65% (=193/2000). Therefore, the increase rate in the individual target temperature in the fourth region with respect to the maximum moving average value (M28) in the fourth region is larger than the increase rate in the individual target temperature in the first region with respect to the maximum moving average value (M28) in the first region. In this way, the increase rate in the individual target temperature in the downstream region with respect to the maximum moving average value (M28) in the downstream region is larger than the increase rate in the individual target temperature in the upstream region with respect to the maximum moving average value (M28) in the upstream region. The increase rate in the individual target temperature in the downstream region with respect to the maximum moving average value (M28) in the downstream region is an example of "the increase rate in the target temperature in the downstream region with respect to the second value in the downstream region." The increase rate in the individual target temperature in the upstream region with respect to the maximum moving average value (M28) in the upstream region is an example of "the increase rate in the target temperature in the upstream region with respect to the second value in the upstream region."

Table 2 shows an example of the maximum moving average values (M3, M28) and the result of calculating the target temperature T.

TABLE 2

| | Rank | | Individual target temperature in each |
|---|---|---|---|
| Region | M3 | M28 | region (° C.) |
| 1 | 4 | 3 | 204 − 12 = 192 |
| 2 | 5 | 3 | 204 − 11 = 193 |

TABLE 2-continued

| Region | Rank M3 | Rank M28 | Individual target temperature in each region (° C.) |
|---|---|---|---|
| 3 | 3 | 3 | 204 − 6 = 198 |
| 4 | 3 | 2 | 204 − 9 = 195 |
| 5 | 0 | 0 | 204 − 14 = 190 |
| Target temperature T (° C.) | | | 198 |

As shown in Table 2, the highest temperature among the individual target temperatures in the regions (198° C. in the third region) is the target temperature T. Cold offset may be caused when only a small amount of heat is applied to a toner image on the recording material P. The cold offset is a shortage of heat for fixing the toner image onto the recording material P. In order to prevent the cold offset and other fixing failures, the highest temperature among the individual target temperatures in each region is determined as the target temperature T. The image processing unit 303 determines the highest temperature among the individual target temperatures in each of the first to fifth regions as the target temperature T. The engine control unit 302 controls power supplied to the heater 11 so that the temperature of the heater 11 is maintained at the highest temperature among the individual target temperatures (target temperature T) in each of the first to fifth regions.

Figure 9:
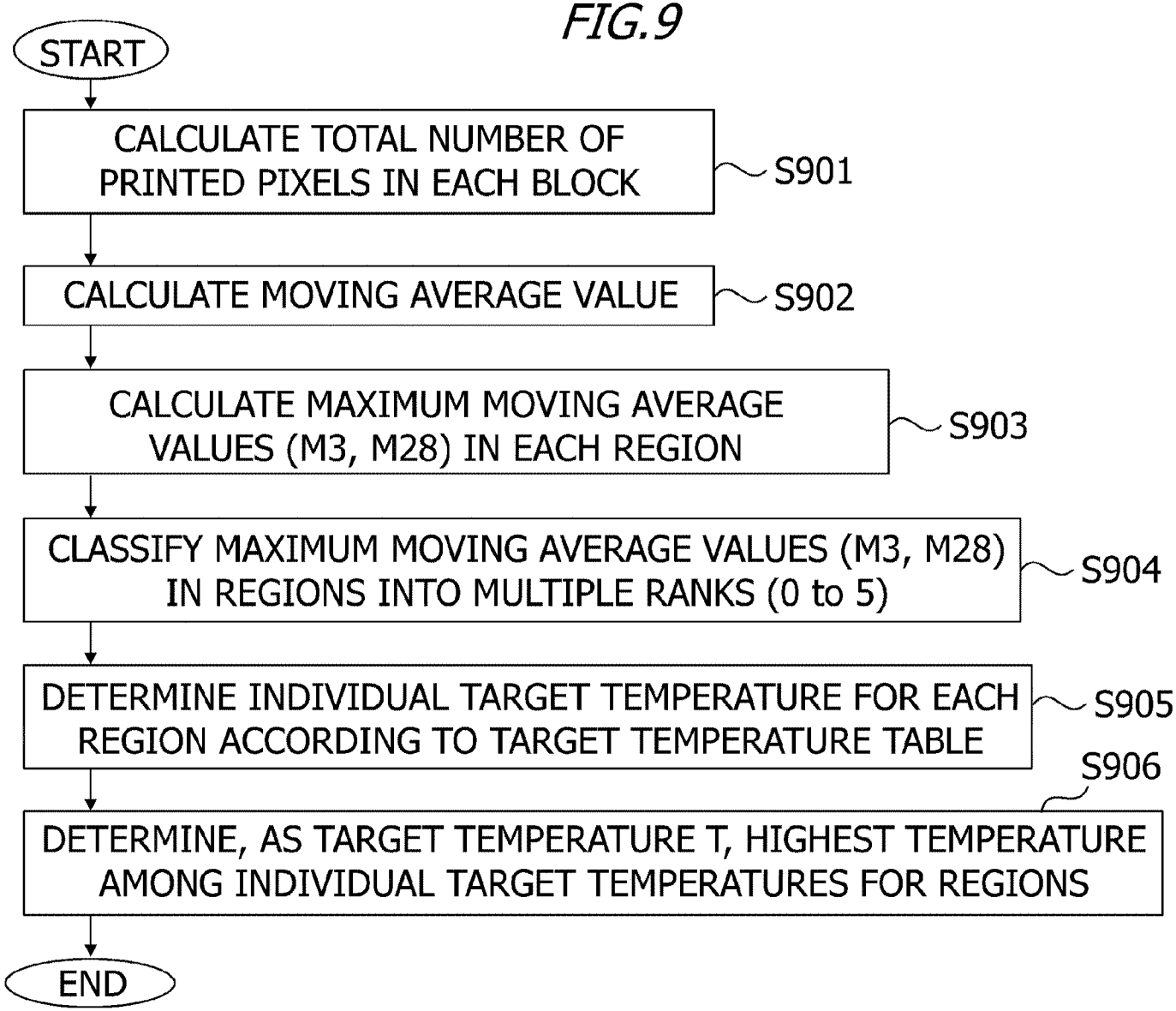
FIG. 9 is a flowchart for illustrating the processing of determining a target temperature according to the first embodiment.

FIG. 9 shows the flow of the processing of determining a target temperature. In S901, the image processing unit 303 calculates the total number (sum) of printed pixels in each block. In S902, the image processing unit 303 calculates a moving average value for the total number of printed pixels in each block using the moving average widths X(X=3, X=28). In S903, the image processing unit 303 calculates the maximum moving average values (M3, M28) in each region. In S904, the image processing unit 303 classifies the maximum moving average values (M3, M28) in each region as a plurality of ranks (ranks 0 to 6). In S905, the image processing unit 303 determines the individual target temperature in each region on the basis of the target temperature table for the region. In S906, the image processing unit 303 determines the highest temperature among the individual target temperatures in each region as the target temperature T.

Reasons for Using Moving Average Method

When a thin film is used for the fixing film 13, since the heat capacity of the fixing film 13 is small, the time until the temperature of the heater 11 reaches the target temperature T is short, and therefore a first print out time (FPOT) can be shortened. Meanwhile, as the recording material P is conveyed to the heating/fixing apparatus 6, and heat is gradually deprived from the fixing film 13 from the surface of the fixing film 13 to the recording material P or the toner, for example as the fixing film 13 turns once, twice, and three times on the recording material P, and the fixability to the recording material P may be lowered at the rear end part of the recording material P.

Therefore, from the front end of the image data in the sub scanning direction, the region corresponding to the first turn of the fixing film 13 is the first region, the region corresponding to the second turn of the fixing film 13 is the second region, and the region corresponding to the third turn of the fixing film 13 is the third region. From the front end of the image data in the sub scanning direction, the region corresponding to the fourth turn of the fixing film 13 is the fourth region, and the region corresponding to the fifth turn of the fixing film 13 is the fifth region. When the size and density of an image in each region are detected and there is an image with poor fixability in the rear part of the image data, a high target temperature T is preferably set in advance in order to prevent fixing failures. Meanwhile, when there is no image with power fixability in the rear part of the image data, the target temperature T is preferably lowered in advance in order to reduce the power consumption.

Figure 10A:
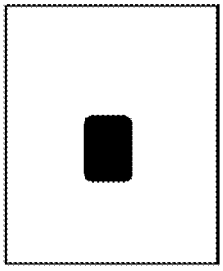
FIGS. 10A to 10C are views for illustrating an advantage brought about by the moving average method.
Figure 10B:
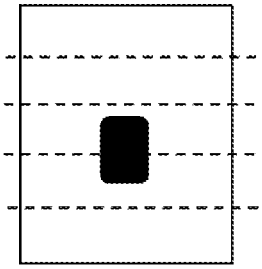
Figure 10C:
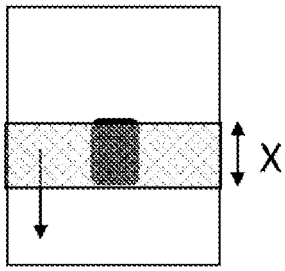

When the size of the toner image on the recording material P is large or when the toner image on the recording material P is long with respect to the conveying direction of the recording material P, heat is continuously deprived from the heater 11, and the fixability is lowered. When an image exists across adjacent regions, the target temperature T must be determined by grasping the size of the image. The simplest method for determining how large an image exists in each area is to calculate the print rate of each area. However, as for the image shown in FIG. 10A for example, according to the method for calculating the print rate, there is a possibility that the image existing across the two adjacent regions may be erroneously determined as shown in FIG. 10B. More specifically, when an image exists across two adjacent regions, the print rate of each of the two adjacent regions is half as compared to the case where an image exists in one region. In contrast, according to the moving average method, the position and size of an image can be grasped even when the image exists across two adjacent regions as shown in FIG. 10C.

Moving Average Width

The moving average width is preferably close to the length of the periphery of the fixing film 13. More specifically, the moving average width is preferably a length corresponding to the length of the sub scanning direction of each region. In this way, the print rate of each of the first to fifth regions and the size of the image that exists across regions can be grasped at the same time. The first moving average width (X=28) corresponds to the length of the sub scanning direction of each region. In an image such as a longitudinal strip having a length of at least the periphery of the film in the sub scanning direction, toner continuously deprives a particular part of the fixing film 13 of heat, so that the fixability of the toner becomes lower even when the print rate of the entire image is low. If there is an image having a length of at least the periphery of the film in the sub scanning direction, the target temperature T must be higher. When the rank of the maximum moving average value M28 is high, it is highly likely that there is an image such as a vertical strip having a length of at least the periphery of the film in the sub scanning direction. The length of the first moving average width (X=28) in the sub scanning direction corresponds to the length (distance) of the outer periphery of the fixing film 13.

According to the first embodiment, the image processing unit 303 calculates the moving average value for the total number of printed pixels in each block using the second moving average width (X=3) together with the first moving average width (X=28). The basic target temperature is preferably determined using the first moving average width (X=28) from the above-described viewpoint, but the second moving average width (X=3) may also be used to lower the target temperature T in some cases. Even when the rank of the maximum moving average value M28 is high, the long image in the lateral direction (main scanning direction) in FIG. 7A does not continue to deprive a particular part of the heater 11 or the fixing film 13 of heat, so that the target temperature T can be lowered. As for a horizontal text image, there is a little connection in the vertical direction (sub scanning direction), which makes it easier to fix, and the rank of the maximum moving average (M3) is likely to be large. In the target temperature tables in FIG. 8, when the rank of the maximum moving average value (M28) is compared with respect to the same value (for example, rank 2), the subtraction value increases and the target temperature T decreases as the rank of the maximum moving average value (M3) increases.

As for a horizontal line image or text image or text image having a width substantially the same as the width of the fixing nip portion or less than the width of the fixing nip portion, since each of the images can be enclosed in the fixing nip portion, it can be easy to fix the image, and the target temperature T can be substantially lowered. The length of the second moving average width (X=3) in the sub scanning direction corresponds to the length (about 6 mm) of the width of the fixing nip portion in the sub scanning direction.

Fixability Evaluation Method

Figure 11:
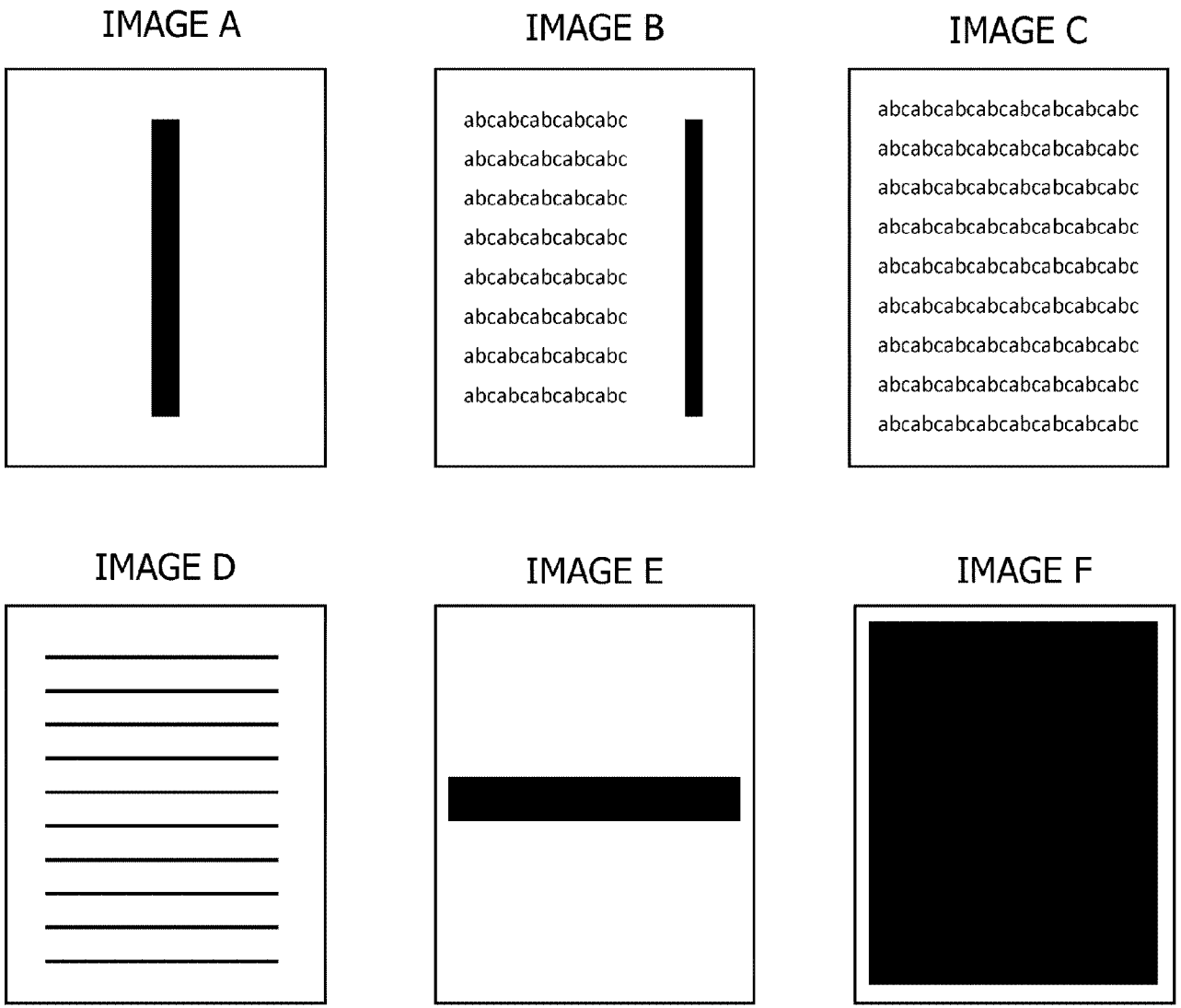
FIG. 11 is a view for illustrating exemplary images used for fixability evaluation according to the first embodiment.

In order to determine the effect of the first embodiment, images A to F shown in FIG. 11 were printed on 10 sheets in succession in an environment with a temperature of 25° C. and a humidity of 50%, and the fixability and power were evaluated. The images A to E in FIG. 11 all have a print rate of 8%, and the image F in FIG. 11 is a solid black image with a print rate of 100%. Fixability was evaluated visually using an A4 size sheet (CANON, Red Label 80 g/cm$^2$). The criteria for the evaluation of fixability are as follows.

Good:No image defects due to a fixation failure were observed and there was no problem.

Ordinary: A few blank dots caused by a fixation failure were observed, but there was practically no problem.

No Good:Many blank dots due to a fixation failure were observed. Toner partly stuck to the fixing film 13, and a toner stain was observed in the margin at the rear end of the image, which is practically not good.

Power was measured by connecting a power meter (digital power meter WT310 manufactured by Yokogawa Test & Measurement Corporation) to the heater 11 in series and reading a measured value after consecutively printing 10 sheets. In order to fairly evaluate the fixability and compare electric power values, a sufficient time period was taken after the previous examination was completed and it was determined that the temperature of the heating/fixing apparatus 6 had dropped to near room temperature before the following examination was carried out. Comparative examination was also performed with reference to first and second comparative examples shown below.

First Comparative Example

In a first comparative example, as in Japanese Patent Application Publication No. 2016-4231, a method for determining a target temperature T from the print rate of the entire image was applied. The device configuration is exactly the same as in the first embodiment. Table 3 shows the relation between the print rate of the first comparative example and the target temperature T (° C.).

TABLE 3

| Print rate (%) | Target temperature T (° C.) |
|---|---|
| 1% or less | 190 |
| 2% | 191 |
| 3% | 192 |
| 4% | 193 |
| 5% | 194 |
| 6% | 195 |
| 7% | 190 |

TABLE 3-continued

| Print rate (%) | Target temperature T (° C.) |
|---|---|
| 8% | 197 |
| 9% | 198 |
| 10% | 199 |
| 11% | 200 |
| 12% | 201 |
| 13% | 202 |
| 14% | 203 |
| 15% or more | 204 |

Second Comparative Example

In the second comparative example, only one moving average width X(X=28) is used to determine an individual target temperature in each of the first to fifth regions. FIG. 12 shows target temperature tables in the second comparative example. FIG. 12 shows target temperature tables for the first to fifth regions. In the second comparative example, the rank threshold value for the maximum moving average value M28 in each region is the same as the threshold value in Table 1 of the first embodiment. In the second comparative example, a target temperature table in each of the first to fifth regions is referred to, and an individual target temperature in each of the first to fifth regions is determined using each value corresponding to the rank of the maximum moving average value M28 in each region. In the second comparative example, the highest temperature among the individual target temperatures in each region is determined as the target temperature T.

Evaluation Results

Tables 4 to 6 show evaluation results according to the first embodiment and first and second comparative examples.

TABLE 4

| | First embodiment | | |
|---|---|---|---|
| | Fixability | Target temperature T (° C.) | Power (Wh) |
| Image A | Good | 202 | 2.78 |
| Image B | Good | 201 | 2.75 |
| Image C | Good | 195 | 2.69 |
| Image D | Good | 195 | 2.69 |
| Image E | Good | 197 | 2.72 |
| Image F | Good | 204 | 2.81 |

TABLE 5

| | First comparative example | | |
|---|---|---|---|
| | Fixability | Target temperature T (° C.) | Power (Wh) |
| Image A | No Good | 197 | 2.72 |
| Image B | Ordinary | 197 | 2.72 |
| Image C | Good | 197 | 2.71 |
| Image D | Good | 197 | 2.71 |
| Image E | Good | 197 | 2.72 |
| Image F | Good | 204 | 2.81 |

TABLE 6

| | Second comparative example | | |
|---|---|---|---|
| | Fixability | Target temperature T (° C.) | Power (Wh) |
| Image A | Good | 202 | 2.78 |
| Image B | Good | 202 | 2.78 |
| Image C | Good | 199 | 2.74 |
| Image D | Good | 199 | 2.74 |

TABLE 6-continued

| | Second comparative example | | |
|---|---|---|---|
| | Fixability | Target temperature T (° C.) | Power (Wh) |
| Image E | Good | 199 | 2.74 |
| Image F | Good | 204 | 2.81 |

As shown in Table 4, according to the first embodiment, since the fixation evaluation ratings were good for all the images A to F, and an appropriate target temperature T was selected for each image, so that the power consumption can be reduced in some of the images. Meanwhile, since the print rate of the images A to E is the same, the target temperature T for the images A to E is the same in the first comparative example as shown in Table 5. Therefore, in the first comparative example, a fixing failure was observed in the images A and B with poor fixability, and the power consumption values were higher than those according to the first embodiment in the images C and D which were relatively easily fixable. As shown in Table 6, in the second comparative example, the fixation evaluation ratings were good for all the images A to F, but the target temperature T was higher in the images C to E and the power consumption was larger than in the first embodiment. As can be seen from the above evaluation results, according to the first embodiment, the fixability was good for all the images A to F, and in the images such as the horizontal line image and the text image which were easily fixable, the power consumption values were lower than those in the second comparative example. In the first comparative example, when the target temperatures T in the target temperature table in Table 3 are overall set to higher temperatures by several degrees, the fixation evaluation ratings may be improved for all the images A to F, but the power consumption is increased.

In the above description, the image processing unit 303 divides image data into a plurality of regions each having a plurality of blocks in the sub scanning direction. Alternatively, the image processing unit 303 may determine the target temperature T on the basis of a maximum moving average value for a plurality of blocks included in the image data without dividing the image data into a plurality of regions.

Second Embodiment

According to the first embodiment, the highest temperature among the individual target temperatures in each of the regions is determined as the target temperature T, while according to the second embodiment, the target temperatures T1 to T5 are determined for each of the regions. Hereinafter, the difference between the first embodiment and the second embodiment will be described, and the components according to the second embodiment identical to those of the first embodiment will be designated by the same reference characters as those of the first embodiment and their description will not be provided.

The image processing unit 303 determines individual target temperatures for the first region to the fifth region, and it determines the individual target temperatures for the regions as the target temperatures T1 to T5. The processing of determining the individual target temperatures for the first to fifth regions is the same as that according to the first embodiment. Therefore, the image processing unit 303 determines the target temperatures T1 to T5 for a plurality of regions on the basis of the maximum moving average values determined for the plurality of regions.

Referring to Table 2, an example of the processing according to the second embodiment will be described. The image processing unit 303 determines the target temperature T1 as 192° C. when a first part of the recording material P corresponding to the first region passes through the fixing nip portion. The image processing unit 303 determines the target temperature T2 as 193° C. when a second part of the recording material P corresponding to the second region passes through the fixing nip portion. The image processing unit 303 determines the target temperature T3 as 198° C. when a third part of the recording material P corresponding to the third region passes through the fixing nip portion. The image processing unit 303 determines the target temperature T4 as 195° C. when a fourth part of the recording material P corresponding to the fourth region passes through the fixing nip portion. The image processing unit 303 determines the target temperature T5 as 190° C. when a fifth part of the recording material P corresponding to the fifth region passes through the fixing nip portion. As described above, the image processing unit 303 switches between the target temperatures T (T1 to T5) for the plurality of regions in timing in which when the plurality of parts of the recording material P corresponding to the plurality of regions enter the fixing nip portion.

The engine control unit 302 controls power supplied to the heater 11 so that the temperature of the heater 11 is maintained at the target temperature T (T1 to T5) after switching. Since there is a delay until the temperature of the fixing nip portion changes after the target temperature T is switched, the image processing unit 303 switches between the target temperatures T 20 msec before the target part of the recording material P enters the fixing nip portion. For example, the image processing unit 303 switches from the target temperature T1 to the target temperature T2 20 msec before the second part of the recording material P corresponding to the second region enters the fixing nip portion. When the target temperature T1 is switched to the target temperature T2, the engine control unit 302 controls the power supplied to the heater 11 so that the temperature of the heater 11 is maintained at the target temperature T2. The engine control unit 302 may switch among the target temperatures T (T1 to T5) for the plurality of regions depending on the timing when the plurality of parts of the recording material P corresponding to the plurality of regions enter the fixing nip portion. The engine control unit 302 may control the power supplied to the heater 11 so that the temperature of the heater 11 is maintained at the target temperature T (T1 to T5) set by switching.

According to the first embodiment, the fixing film 13 having a thickness of 80 μm is used, while according to the second embodiment, the fixing film 13 having a thickness of 50 μm may be used. Therefore, the fixing nip portion can have improved temperature following ability in response to switching among the target temperatures T1 to T5.

Table 7 shows the result of evaluation about fixability and power for the images A to F. The images A to F and the evaluation method are the same as those according to the first embodiment.

TABLE 7

| | | Target temperature T (° C.) | | | | | Power |
|---|---|---|---|---|---|---|---|
| | Fixability | T1 | T2 | T3 | T4 | T5 | (Wh) |
| Image A | Good | 198 | 199 | 201 | 201 | 202 | 2.75 |
| Image B | Good | 197 | 198 | 200 | 200 | 201 | 2.74 |

TABLE 7-continued

| | Fixability | Target temperature T (° C.) T1 | T2 | T3 | T4 | T5 | Power (Wh) |
|---|---|---|---|---|---|---|---|
| Image C | Good | 190 | 191 | 192 | 193 | 195 | 2.67 |
| Image D | Good | 190 | 191 | 192 | 193 | 195 | 2.67 |
| Image E | Good | 190 | 190 | 197 | 190 | 190 | 2.69 |
| Image F | Good | 204 | 204 | 204 | 204 | 204 | 2.81 |

According to the second embodiment, since the target temperature T (T1 to T5) for each region is determined, the target temperature T (T1 to T5) can be lowered for each region, so that the power consumption can be more reduced than the first embodiment. In order to switch among the target temperatures T for the regions and cause the temperature of the fixing nip portion to follow the target temperature T, the fixing film 13 preferably has a reduced thickness as described above. Meanwhile, when the film thickness of the fixing film 13 is reduced, the film durability is reduced, and the useful life of the device may be shortened. In view of the useful life of the device, it may be determined whether to set one target temperature T as in the first embodiment or a target temperature T (T1 to T5) for each region as in the second embodiment. Similarly to the first embodiment, the increase ratio in the target temperature T in the downstream region with respect to the maximum moving average values (M3, M28) in the downstream region is larger than the increase ratio in the target temperature T in the upstream region with respect to the maximum moving average values (M3, M28) in the upstream region.

Modifications

According to the first and second embodiments, the maximum moving averages (M3, M28) are ranked using the same threshold table. Alternatively, a first threshold table for classifying the maximum moving average value (M3) into a plurality of ranks and a second threshold table for classifying the maximum moving average value (M28) in a plurality of ranks may be used.

According to the first and second embodiments, a moving average value is calculated using two kinds of moving average widths X(X=3, X=28) corresponding to the outer peripheral length of the fixing film 13 and the length of the fixing nip portion, and the target temperature T is determined. Alternatively, there may be three or more moving average widths X. The image processing unit 303 may select two kinds of moving average widths X from three or more kinds of moving average widths X with different lengths in the sub scanning direction. The image processing unit 303 may calculate a moving average value using the three or more kinds of moving average widths X to determine a target temperature T. For example, as the pressure roller 20 rotates one or two turns after the front end of a recording material P enters the fixing nip portion, the heat of the pressure roller 20 is deprived by the recording material P, and the surface temperature of the pressure roller 20 decreases. The outer peripheral length of the pressure roller 20 is 62.8 mm (20 mm×3.14), and using the third moving average width (X=31), a moving average value for the total number of printed pixels in each block may be calculated. The length of the third moving average width (X=31) in the sub scanning direction corresponds to the length (distance) of the outer periphery of the pressure roller 20.

When the temperature of the core bar 21 of the pressure roller 20 is low, the surface temperature of the pressure roller 20 decreases significantly as the pressure roller 20 rotates, which may greatly affect the fixability. In this case, the image processing unit 303 calculates a moving average value for the total number of printed pixels in each block using the moving average width (X=31) corresponding to the outer peripheral length of the pressure roller 20 and the moving average width (X=3) corresponding to the length of the fixing nip portion. The image processing unit 303 calculates the maximum moving average values (M3, M31) in each region. The image processing unit 303 classifies the maximum moving average values (M3, M31) in each region into a plurality of ranks (ranks 0 to 6). The image processing unit 303 determines the individual target temperatures in the regions on the basis of the target temperature tables for the regions. The image processing unit 303 determines the highest temperature among the individual target temperatures for the regions as the target temperature T. Similar to the second embodiment, the image processing unit 303 may determine individual target temperatures for the first to fifth regions as the target temperatures T (T1 to T5) for the regions.

Meanwhile, when the core bar 21 of the pressure roller 20 is somewhat warm, the decrease in the surface temperature of the pressure roller 20 is small and does not affect the fixability much. In this case, the image processing unit 303 calculates a moving average value for the total number of printed pixels in each block using the moving average width X(X=28) corresponding to the outer peripheral length of the fixing film 13 and the moving average width X(X=3) corresponding to the length of the fixing nip portion.

The image forming apparatus 100 may include a sensing unit that detects the temperature of the surface of the pressure roller 20. The temperature of the surface of the pressure roller 20 sensed by the sensing unit is sent to the image processing unit 303. The image processing unit 303 selects a plurality of moving average widths according to the temperature of the surface of the pressure roller 20. The plurality of moving average widths may be stored in the memory of the image processing unit 303. When the temperature of the surface of the pressure roller 20 is less than a prescribed temperature, the image processing unit 303 may select a first moving average width (X=3) and a second moving average width (X=28) to calculate a moving average value for the total number of printed pixels in each block. Meanwhile, when the temperature of the surface of the pressure roller 20 is not less than the prescribed temperature, the image processing unit 303 may select the first moving average width (X=3) and a third moving average width (X=31) to calculate a moving average value for the total number of printed pixels in each block. As described above, the image processing unit 303 may switch among the second moving average width (X=28) and the third moving average width (X=31) according to the temperature of the surface of the pressure roller 20 to calculate a moving average value for the total number of printed pixels in each block.

The image processing unit 303 may calculate three moving average values and three maximum moving average values (M3, M28, and M31) and select one of three maximum moving average values (M3, M28, and M31) depending on the state of the heating/fixing apparatus 6. A first threshold table for classifying the maximum moving average value (M3) into a plurality of ranks, a second threshold table for classifying the maximum moving average value (M28) into a plurality of ranks, and a third threshold table for classifying the maximum moving average value (M31) into a plurality of ranks may be used.

According to the first and second embodiments, the total number of pixels having density at at least a prescribed value is counted, while using a plurality of thresholds, the total number of pixels may be counted on a density basis in order to calculate a moving average value, and a target temperature T may be determined on the basis of a target temperature table for each level of density. The threshold values in the threshold tables, a moving average width, and the length d of image data in the sub scanning direction in defining one block may be values other than those in the description of the embodiments. For example, the threshold values in the threshold tables, the moving average width, and the length d of the image data in the sub scanning direction in defining one block may be changed as appropriate depending on the kind of toner, the characteristics of members in the heating/fixing apparatus 6, the ease of computing, or the resolution of the temperature setting.

Figure 13:
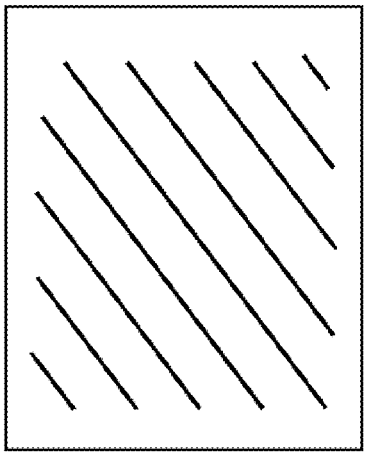
FIG. 13 is a view for illustrating an exemplary image with diagonal lines.

According to the embodiments, the image data can be divided in the sub scanning direction and analyzed, so that he efficiency of image processing may be increased, the memory usage area and the processing time can be reduced. Meanwhile, as for the image G having diagonal lines as shown in FIG. 13, the diagonal lines form an image which can be easily fixed, but the image is determined as an image with poor fixability by the approach according to the embodiments, and therefore, the reduction in the target temperature T is small. However, most line images output by the printer are vertical or horizontal lines, the ratio of the line images with diagonal lines is small, and therefore the effect is small if diagonal lines are determined as an image with poor fixability.

Although the monochrome type laser beam printer according to the first and second embodiments has been described in the foregoing, the same processing may be performed using a color laser beam printer. For example, using a laser beam printer which prints with four colors, cyan, magenta, yellow, and black, the maximum density of each color may be set as 100%, and the total number of pixels with the total density of the colors is at least 100% may be counted.

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-157043, filed on Aug. 29, 2019, which is hereby incorporated by reference herein in its entirety.

What is claimed is:

1. An image forming apparatus comprising:

an image forming portion that forms on a recording material a toner image according to image data;

a fixing portion that holds the recording material at a nip portion formed between a fixing member having a heating member therein and a pressing member and fixes the toner image onto the recording material;

an obtaining portion that divides the image data into a plurality of regions in a sub scanning direction, and obtains, for each of the plurality of regions in the sub scanning direction, a first value relating to pixels having density equal or greater than a prescribed value in a first width and a second value relating to pixels having density equal or greater than the prescribed value in a second width, which is greater than the first width;

a determining portion that determines, for each of the plurality of regions, a target temperature for maintaining a temperature of the heating member on the basis of the first and second values; and a control portion that controls power supplied to the heating member so that the temperature of the heating member is maintained at the target temperature.

2. The image forming apparatus according to claim 1, wherein the first and second widths each are selected from among at least three widths having different lengths in the sub scanning direction.

3. The image forming apparatus according to claim 1, wherein a length of the first width in the sub scanning direction corresponds to a length of a width of the nip portion in the sub scanning direction.

4. The image forming apparatus according to claim 1, wherein a length of the second width in the sub scanning direction corresponds to a length of one round of an outer periphery of the fixing member.

5. The image forming apparatus according to claim 1, wherein a length of the second width in the sub scanning direction corresponds to a length of one round of an outer periphery of the pressing member.

6. The image forming apparatus according to claim 1, wherein the obtaining portion:

divides the image data into a plurality of blocks in the sub scanning direction;

calculates a first average value by dividing a total number of pixels having density equal or greater than the prescribed value in the plurality of blocks included in the first width by the number of the blocks included in the first width each time a position of the first width in the sub scanning direction is changed, and obtains the first value on the basis of the first average value; and calculates a second average value by dividing a total number of pixels having density equal or greater than the prescribed value in the plurality of blocks included in the second width by the number of the blocks included in the second width each time a position of the second width in the sub scanning direction is changed, and obtains the second value on the basis of the second average value.

7. The image forming apparatus according to claim 1, wherein the control portion controls power supplied to the heating member so that the temperature of the heating member is maintained at a highest temperature among the target temperatures determined for the plurality of regions, respectively.

8. The image forming apparatus according to claim 1, wherein the control portion performs switching among the target temperatures for the plurality of regions in accordance with a timing, at which a plurality of parts of the recording member corresponding to the plurality of regions enter the nip portion, and controls power supplied to the heating member so that the temperature of the heating member is maintained at the target temperature set by the switching.

9. The image forming apparatus according to claim 1, wherein the plurality of regions include an upstream region and a downstream region located downstream of the upstream region in the sub scanning direction, an increase rate in the target temperature in the downstream region relative to the first value in the downstream region is larger than an increase rate in the target temperature in the upstream region relative to the first value in the upstream region, and an increase rate in the target temperature in the downstream region relative to the second value in the downstream region is larger than an increase rate in the target temperature in the upstream region relative to the second value in the upstream region.

10. An image forming method for an image forming apparatus including an image forming portion that forms on a recording material a toner image according to image data and a fixing portion that holds the recording material at a nip portion formed between a fixing member having a heating member therein and a pressing member and fixes the toner image onto the recording material, the method being executed by a computer and comprising steps of:

dividing the image data into a plurality of regions in a sub scanning direction, and obtaining, for each of the plurality of regions in the sub scanning direction, a first value relating to pixels having density greater than a prescribed value in a first width and a second value relating to pixels having density greater than the prescribed value in a second width, which is greater than the first width;

determining, for each of the plurality of regions, a target temperature for maintaining a temperature of the heating member on the basis of the first and second values; and controlling power supplied to the heating member so that the temperature of the heating member is maintained at the target temperature.

11. The image forming method according to claim 10, wherein the first and second widths each are selected from among at least three widths having different lengths in the sub scanning direction.

12. The image forming method according to claim 10, wherein a length of the first width in the sub scanning direction corresponds to a length of a width of the nip portion in the sub scanning direction.

13. The image forming method according to claim 10, wherein a length of the second width in the sub scanning direction corresponds to a length of one round of an outer periphery of the fixing member.

14. The image forming method according to claim 10, wherein a length of the second width in the sub scanning direction corresponds to a length of one round of an outer periphery of the pressing member.

15. The image forming method according to claim 10, wherein the obtaining step includes steps of:

dividing the image data into a plurality of blocks in the sub scanning direction;

calculating a first average value by dividing a total number of pixels having density equal or greater than the prescribed value in the plurality of blocks included in the first width by the number of the blocks included in the first width each time a position of the first width in the sub scanning direction is changed, and obtaining the first value on the basis of the first average value; and calculating a second average value by dividing a total number of pixels having density equal or greater than the prescribed value in the plurality of blocks included in the second width by the number of the blocks included in the second width each time a position of the second width in the sub scanning direction is changed, and obtaining the second value on the basis of the second average value.

16. The image forming method according to claim 10, wherein the controlling step includes a step of controlling power supplied to the heating member so that a temperature of the heating member is maintained at a highest temperature among the target temperatures determined for the plurality of regions, respectively.

17. The image forming method according to claim 10, wherein the controlling step includes a step of performing switching among the target temperatures in the plurality of regions in accordance with a timing, at which a plurality of parts of the recording member corresponding to the plurality of regions enter the nip portion, and controlling power supplied to the heating member so that the temperature of the heating member is maintained at the target temperature set by the switching.

18. The image forming method according to claim 10, wherein the plurality of regions include an upstream region and a downstream region located downstream of the upstream region in the sub scanning direction, an increase rate in the target temperature in the downstream region relative to the first value in the downstream region is larger than an increase rate in the target temperature in the upstream region relative to the first value in the upstream region, and an increase rate in the target temperature in the downstream region relative to the second value in the downstream region is larger than an increase rate in the target temperature in the upstream region relative to the second value in the upstream region.

19. A computer-readable recording medium with a program recorded therein for causing a computer to execute steps in an image forming method for an image forming apparatus including an image forming portion that forms on a recording material a toner image according to image data and a fixing portion that holds the recording material at a nip portion formed between a fixing member having a heating member therein and a pressing member and fixes the toner image onto the recording material, the program causing the computer to execute the steps of:

dividing the image data into a plurality of regions in a sub scanning direction, and obtaining, for each of the plurality of regions in the sub scanning direction, a first value relating to pixels having density equal or greater than a prescribed value in a first width and a second value relating to pixels having density equal or greater than the prescribed value in a second width, which is greater than the first width;

determining, for each of the plurality of regions, a target temperature for maintaining a temperature of the heating member on the basis of the first and second values; and controlling power supplied to the heating member so that the temperature of the heating member is maintained at the target temperature.

* * * * *